US012172042B1

(12) United States Patent
Gubera et al.

(10) Patent No.: US 12,172,042 B1
(45) Date of Patent: Dec. 24, 2024

(54) METHOD AND SYSTEM FOR PROVIDING LOWER BODY WEIGHT TRAINING FITNESS

(71) Applicant: Animalhouse Ventures Inc., Stockton, CA (US)

(72) Inventors: Evan Gubera, Simpsonville, SC (US); Paul Jackson, Lafayette, CA (US)

(73) Assignee: Animalhouse Ventures Inc., Stockton, CA (US)

( * ) Notice: Subject to any disclaimer, the term of this patent is extended or adjusted under 35 U.S.C. 154(b) by 200 days.

(21) Appl. No.: 17/808,461

(22) Filed: Jun. 23, 2022

Related U.S. Application Data

(60) Provisional application No. 63/202,852, filed on Jun. 28, 2021.

(51) Int. Cl.

| | |
|---|---|
| ***A63B 21/065*** | (2006.01) |
| ***A63B 21/00*** | (2006.01) |
| ***A63B 21/072*** | (2006.01) |
| ***A63B 21/075*** | (2006.01) |
| ***A63B 23/035*** | (2006.01) |
| ***A63B 23/04*** | (2006.01) |

(52) U.S. Cl.
CPC ..... *A63B 21/065* (2013.01); *A63B 21/075* (2013.01); *A63B 21/4015* (2015.10); *A63B 23/03508* (2013.01); *A63B 23/04* (2013.01); *A63B 21/0728* (2013.01); *A63B 2209/08* (2013.01); *A63B 2209/10* (2013.01); *A63B 2214/00* (2020.08)

(58) Field of Classification Search
CPC . A63B 21/065; A63B 21/075; A63B 21/4015; A63B 21/0728; A63B 23/03508; A63B 23/04; A63B 2209/08; A63B 2209/10; A63B 2214/00
See application file for complete search history.

(56) References Cited

U.S. PATENT DOCUMENTS

| | | | | |
|---|---|---|---|---|
| 5,722,919 | A * | 3/1998 | Timmer | A63B 23/08 482/79 |
| 6,010,438 | A | 1/2000 | Fitzgerald | |
| 6,196,950 | B1 * | 3/2001 | Emick | A63B 21/4015 482/79 |
| 7,785,239 | B2 * | 8/2010 | Daniel | A63B 21/0728 482/93 |

(Continued)

FOREIGN PATENT DOCUMENTS

| | | |
|---|---|---|
| DE | 3514513 | 10/1986 |
| EP | 1447115 | 8/2004 |
| WO | WO 03/092424 | 11/2003 |

*Primary Examiner* — Megan Anderson
(74) *Attorney, Agent, or Firm* — Hawley Troxell; Philip McKay

(57) ABSTRACT

An adjustable lower body fitness device attaches to the user's foot using a body attachment portion and includes an integrated and adjustable weight portion that can be set to a desired weight by adding or subtracting weight increments. Once a user attaches the adjustable lower body fitness device to the user's foot using a body attachment portion, the entire adjustable lower body fitness device becomes an extension of the user's leg that allows users to effectively and efficiently exercise their lower body and core while also providing flexibility, minimal floor space/storage requirements, simplicity, relatively low cost, and minimal maintenance requirements.

20 Claims, 21 Drawing Sheets

(56) References Cited

U.S. PATENT DOCUMENTS

| | | | | |
|---|---|---|---|---|
| 8,439,854 | B2 * | 5/2013 | Terrio | A61H 1/0266 482/79 |
| 9,868,014 | B1 * | 1/2018 | Lake | A63B 21/4034 |
| 10,413,774 | B2 * | 9/2019 | Weber | A63B 21/0601 |
| 10,881,895 | B2 * | 1/2021 | Gubera | A63B 23/04 |
| 10,953,264 | B2 * | 3/2021 | Towley, III | A63B 21/0726 |
| 2009/0131233 | A1 * | 5/2009 | Seitzer | A63B 21/4015 482/105 |
| 2014/0194259 | A1 * | 7/2014 | Alpert | A63B 21/065 482/105 |
| 2017/0216651 | A1 | 8/2017 | Weber | |
| 2018/0099174 | A1 * | 4/2018 | Biggs | A43C 19/00 |

* cited by examiner

100

100

100

METHOD AND SYSTEM FOR PROVIDING LOWER BODY WEIGHT TRAINING FITNESS

CROSS REFERENCE TO RELATED APPLICATIONS

This application claims the benefit of U.S. Provisional Patent Application No. 63/202,852, naming Evan Gubera as inventor, entitled "LEG EXERCISE DEVICE," filed on Jun. 28, 2021, which is hereby incorporated by reference in its entirety as if it were fully set forth herein.

BACKGROUND

Over the past century machines have progressively taken over many tasks once allocated to manual labor. As a result, for many human beings the workplace has become less and less physical and more and more sedentary. As a result, most people now rely on dedicated physical exercise routines in order to maintain acceptable levels of fitness, strength, and health. In addition, in the absence of physical labor, many people now rely heavily, and often exclusively, on exercise equipment, such as various cardio and weight lifting machines and systems to maintain their strength, health, and general wellbeing.

However, weight lifting machines and systems currently available are often expensive, complicated, and require significant maintenance. For this reason alone, most people cannot afford to own these machines. In addition, many weight lifting machines and systems are quite large and require significant space for both use and storage. Since most people do not have space in their homes for these devices this fact also limits people's capability to own these machines/systems. This space issue has become more and more problematic as property prices continue to rise and many people are turning to smaller and smaller living spaces, as are many businesses such as gyms.

As a result of the cost, maintenance, and space issues discussed above, many people have historically relied on public gyms and gym memberships to gain access to weight machines/systems to maintain their strength and health. In these instances, gym members rely on gym facilities to provide, maintain, and store various types of exercise machines and systems. However, the use of "public" gyms has recently fallen from favor. This has been caused by various factors including heighted sanitary concerns and social distancing arising from the recent, and on-going, pandemic; increased wait times for equipment, often made worse by the need for social distancing and by increasing populations; rising gym membership costs; a lack of privacy in gyms; security concerns; and, in many cases, restriction on both the duration of use of machines and limited times that the public gyms can be accessed.

As a result of these and other concerns, it is becoming more and more difficult for people to maintain their health by relying on traditional gyms to provide access to various types of workout machines/systems. Consequently, there is increased emphasis on methods of exercise and body training regimes that can be implemented at home or in other private settings, are relatively mobile, and are relatively simple and efficient to use and maintain. However, some exercises and body training regimes have proven particularly difficult to effectively perform in a private/home setting or other confined space.

One specific example of exercises and body training regimes that have proven difficult to perform in a home/ smaller footprint setting are exercises and body training regimes that are focused on the lower body and core; e.g.; that strengthen the upper legs, lower legs, abdomen, and back. This is because traditional weight lifting machines and systems that work these body parts are historically large, heavy, expensive, complicated, and take up considerable space.

Many prior art lower body and core development machines and systems include traditional bench and/or seat-based leg lifting machines that often consist of a full body bench, a large selectable weight stack, pulleys, and special leg lift extensions. Consequently, these prior art lower body and core development machines and systems are complicated; often include pulley mechanisms that must be maintained, and which can represent a source of injury; have large and often bulky weight stacks; and can easily require twenty to thirty square feet of floor space per machine/system. To make matters worse, in the case of leg weight training systems, there are often separate traditional leg lift machines for working the front and the back of the legs and the lower body/abdomen and back. Consequently, very few people can afford, or have the available space required for, prior art lower body and core development machines and systems such as traditional leg lift machines.

In addition, many prior art lower body and core development machines and systems such as traditional leg lift machines significantly restrict the user's position and movement while using the machine by requiring the user to maintain a prone or seated position while using the machine. This results in highly isolated and restricted strength training. This, in turn, often means that several exercises, requiring several different machines, are needed to provide a true full lower body workout. Of course, this results in even more expense and space utilization.

More recently, some lower body and core development devices have been introduced that allow a user to incorporate free weights, such as dumbbells, into the lower body and core development device. However, by relying on the incorporation of free weights, such as dumbbells, these lower body and core development devices require sets of dumbbells to accommodate different weights, to allow for versatility, and to accommodate different exercises and different/evolving levels of strength. Consequently, using these dumbbell-based lower body and core development devices, the user must often acquire, maintain, and store, expensive sets of dumbbells. This again results in cost and storage issues similar to those discussed above.

In light of the issues set forth above, historically, and particularly in light of present pandemic and social distancing requirements, many people have been unable to adequately workout and strengthen their lower body and core. Unfortunately, as any health expert will tell you, this is a significant problem because it is highly desirable to exercise the entire body and keep muscle balance within the entire human system.

What is needed, is a technical solution to the long standing problem of providing a method and system that allows users to effectively and efficiently exercise their lower body and core while also providing flexibility, minimal floor space/storage requirements, simplicity, relatively low cost, and minimal maintenance requirements.

SUMMARY

Embodiments of the present disclosure provide a technical solution to the long-standing technical problem of providing a method and system that allows users to effectively and efficiently exercise their lower body and core while also providing flexibility, minimal floor space/storage requirements, simplicity, relatively low cost, and minimal maintenance requirements. In various embodiments, this is accomplished by providing an adjustable lower body fitness device that is designed to attach to the users foot and thereby become an extension of the user's leg. In various embodiments, the disclosed adjustable lower body fitness device includes a body attachment portion and an adjustable weight portion that can be adjustably set to a desired weight by adding or subtracting relatively small form weight increments that, in some embodiments can be stacked to minimize the space required to use and store the disclosed adjustable lower body fitness devices.

In one embodiment, the adjustable lower body fitness device includes a body attachment portion, an adjustable weight portion made up of one or more weight increments, a stack or docking station including two or more weight increments, and a weight selection mechanism.

In one example, at least part of the adjustable lower body fitness device is manufactured through injection molding techniques.

In one embodiment, a user desiring to work their lower body uses the body attachment portion to attach the adjustable lower body fitness device to their foot/ankle. In one embodiment, the body attachment portion includes a base support portion, lateral support portion, and front portion. In one embodiment, the base support portion includes a flat portion to accept at least part of the bottom of a user's foot. In one embodiment, the body attachment portion includes one or more strap mechanisms used to secure the user's foot and/or ankle to the adjustable lower body fitness device by securing the user's foot and/or ankle to the base support portion and lateral support portions of the body attachment portion of the adjustable lower body fitness device.

In one embodiment, the one or more strap mechanisms wrap around a portion of the user's lower foot.

In another embodiment, a user desiring to work their lower body uses the body attachment portion to attach the adjustable lower body fitness device to their foot/ankle. In one embodiment, the body attachment portion includes a base support portion, lateral support portion, and front portion. In one embodiment, the base support portion includes a flat portion to accept at least part of the bottom of a user's foot. In one embodiment, the lateral support portion includes a cupping surface to accept at least a portion of the user's heel and/or ankle. In one embodiment, the front portion is designed to fit over at least a portion of front of the user's foot and/or ankle.

In one embodiment, the body attachment portion includes one or more strap mechanisms used to secure the user's foot and/or ankle to the adjustable lower body fitness device by securing the user's foot and/or ankle between an adjustable space/cavity formed by the base support portion, lateral support portion, and front portion of the body attachment portion of the adjustable lower body fitness device.

In one embodiment, the one or more strap mechanisms wrap around a portion of the user's lower foot. In one embodiment, the one or more strap mechanisms include hinges that press fit into respective openings of the base support portion and the lateral support portion thereby coupling together the base support portion and the lateral support portion. In one embodiment, the one or more strap mechanisms are attached to the base support portion using snap or press fit, mechanical fasteners, such as hook and loop, simple loop, tie buckles, clips, or any other suitable mechanism to attach the one or more strap mechanisms to the base support portion.

In one embodiment, the base support portion and the lateral support portion rotate about one or more hinges to allow for ease of attachment of the body attachment portion and/or to accommodate a greater variety of user foot sizes and shoes. In one embodiment, the hinges are formed from metal, for example, aluminum, titanium, or steel, injection molded plastic, or any other suitable material.

In various embodiments, the body attachment portion can be any mechanism, as discussed herein, known in the art at the time of filing, and/or as developed/made available after the time of filing that allows a user to attach the adjustable lower body fitness device to their foot, ankle, or leg.

In one embodiment, an adjustable weight portion is attached to, or is an integrally formed part of, to the body attachment portion such that when the user uses the body attachment portion to attach the adjustable lower body fitness device to their foot, ankle, and/or leg, the adjustable weight portion is also attached to the user's foot, ankle, and/or leg such that the entire adjustable lower body fitness device, including the body attachment portion and the adjustable weight portion, becomes a removably attached extension of the user's leg.

In one embodiment, the adjustable weight portion includes one or more weight increments that together make up the adjustable amount of weight included in the adjustable weight portion. In one embodiment, the number of weight increments included in the adjustable weight portion is selected by the user by adding or subtracting weight increments to achieve a desired total weight of the adjustable weight portion.

In various embodiments, the weight increments are formed from metal, for example, aluminum, titanium, or steel; injection molded plastic; ceramics, concrete, or any other suitable material as discussed herein, known in the art at the time of filing, and/or as developed/made available after the time of filing, that can be used to create/provide a weight increment.

In some embodiments, the weight increments making up the adjustable weight portion are combined, e.g., stacked/attached and/or otherwise combined, to make up the desired weight using one of several weight increment attachment mechanisms. As one example, the weight increment attachment mechanism for adding or subtracting weight increments making up the adjustable weight portion can be a slot and selection plate weight increment attachment mechanism.

As another example, the weight increment attachment mechanism for adding or subtracting weight increments making up the adjustable weight portion can be a hole and pin weight increment attachment mechanism.

As another example, the weight increment attachment mechanism for adding or subtracting weight increments making up the adjustable weight portion can be a screw and bolt type weight increment attachment mechanism.

As another example, the weight increment attachment mechanism for adding or subtracting weight increments making up the adjustable weight portion can be a hook and loop, or similar temporary, weight increment attachment mechanism.

As another example, the weight increment attachment mechanism for adding or subtracting weight increments making up the adjustable weight portion can be a slot and groove weight increment attachment mechanism.

As another example, the weight increment attachment mechanism for adding or subtracting weight increments making up the adjustable weight portion can be magnet-based weight increment attachment mechanism.

In one embodiment, the adjustable lower body fitness device includes an adjustable lower body fitness device docking station. In one embodiment, the adjustable lower body fitness device docking station includes a set or sub-set of the weight increments available to be combined and attached to the adjustable weight portion of the adjustable lower body fitness device. In one embodiment, the adjustable lower body fitness device docking station is designed to receive the adjustable lower body fitness device, including the adjustable weight portion. In one embodiment, the adjustable lower body fitness device docking station includes a stacked set or sub-set of the weight increments.

In one embodiment, once the adjustable lower body fitness device is positioned in, or on, the adjustable lower body fitness device docking station the user can select the desired total weight for the adjustable weight portion of the adjustable lower body fitness device using a weight selection mechanism. In one embodiment, once the user selects the desired weight, the weight increment stack including the number of weight increments needed to achieve the desired total weight for the adjustable weight portion of the adjustable lower body fitness device is selected and removably attached to the adjustable weight portion of the adjustable lower body fitness device.

In various embodiments, the weight increment attachment mechanism and/or weight selection mechanism for adding or subtracting weight increments making up the adjustable weight portion can be any weight increment attachment mechanism and/or weight selection mechanism as discussed herein, and/or as known in the art at the time of filing, and/or as developed after the time of filing that allows for the temporary and adjustable addition or subtraction of weight increments making up the adjustable weight portion.

As seen above, and discussed in more detail below, the disclosed adjustable lower body fitness devices are simple, have few moving parts, require minimal floor space, are flexible, and can be made available at a relatively low price. Consequently, the disclosed adjustable lower body fitness devices are ideal for home use, or anywhere that minimizing complexity of equipment and required floor space is desirable. As noted, this is highly desirable in a world of pandemics, working from home, variable and unpredictable hours, and a general desire for privacy, safety, and convenience when working out.

In addition, since the disclosed adjustable lower body fitness devices are attached as an extension of the user's foot/leg, the disclosed adjustable lower body fitness devices allow for freedom of movement and a variety of positions not available using traditional leg lift machines or other prior art systems. As noted above, this fact makes it easier to obtain more complete lower body workouts that address more muscle groups and help balance overall strength conditioning.

Likewise, due to their small size and that they are an extension of the user's foot/leg, the disclosed adjustable lower body fitness devices can lend themselves to group training/classes when that is desired. In these instances, each user is able to adjust their own weight level and therefore customize their workout to their needs/skills.

In addition, in contrast to adjustable lower body fitness devices that rely on the use of expensive and bulky free weights such a dumbbells, the disclosed adjustable lower body fitness devices use relatively compact weight increments that can be easily stacked and stored, in one embodiment in stacked docking stations. As a result, using the disclosed adjustable lower body fitness devices there is no need to invest in, maintain, and store sets/racks of dumbbells or other space intensive weight systems in order to provide variable levels of workout and flexibility.

As a result of these and other disclosed features, which are discussed in more detail below, the disclosed embodiments address the short comings of the prior art and provide a technical solution to the long-standing technical problem of providing a method and system that allows users to effectively and efficiently exercise their lower body and core while also providing flexibility, minimal floor space and storage requirements, simplicity, relatively low cost, and minimal maintenance requirements.

Further details and embodiments and methods are described in the detailed description below. The summary above, nor the detailed description below, do not purport to define or limit the invention. Rather, the invention is defined by the included claims.

Figure 1:
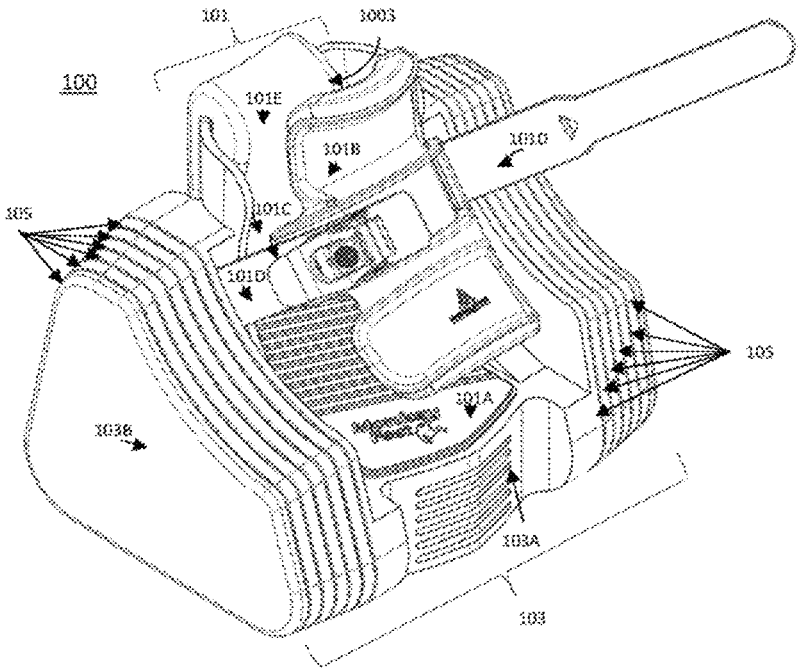
FIG. 1 is a diagram of a front perspective view of one specific example of the disclosed adjustable lower body fitness devices, in accordance with one embodiment.

Common reference numerals are used throughout the FIGs. and the detailed description to indicate like elements. One skilled in the art will readily recognize that the above FIGs. are merely illustrative examples and that other structures, modes of operation, orders of operation, and elements/functions can be provided and implemented without departing from the characteristics and features of the invention, as set forth in the claims.

DETAILED DESCRIPTION

Embodiments will now be discussed with reference to the accompanying FIGs., which depict one or more exemplary embodiments. Embodiments may be implemented in many different forms and should not be construed as limited to the embodiments set forth herein, shown in the FIGs., or described below. Rather, these exemplary embodiments are provided to allow a complete disclosure that conveys the principles of the invention, as set forth in the claims, to those of skill in the art.

Disclosed herein is an adjustable lower body fitness device that is designed to attach to the users foot and thereby become an extension of the user's leg. In various embodiments, the disclosed adjustable lower body fitness device includes a body attachment portion and an adjustable weight portion that can be adjustably set to a desired weight by adding or subtracting relatively small form weight increments.

The disclosed adjustable lower body fitness devices are simple, have few moving parts, require minimal floor space, are flexible, and can be made available at a relatively low price. Consequently, the disclosed adjustable lower body fitness devices are ideal for home use, or anywhere that minimizing complexity of equipment and required floor space is desirable. As noted, this is highly desirable in a world of pandemics, working from home, variable and unpredictable hours, and a general desire for privacy and convenience when working out.

In addition, the disclosed adjustable lower body fitness devices are attached as an extension of the user's foot/leg. Therefore, the disclosed adjustable lower body fitness devices allow for freedom of movement and a variety of positions not available using traditional leg lift machines or other prior art systems. As noted above, this fact makes it easier to obtain more complete lower body workouts that address more muscle groups and help balance overall strength conditioning.

Likewise, due to their small size and that they are an extension of the user's foot/leg, the disclosed adjustable lower body fitness devices can lend themselves to group training/classes when that is desired. In these instances, each user is able to adjust their own weight level and therefore customize their workout to their needs/skills.

In addition, in contrast to adjustable lower body fitness devices that rely on the use of expensive and bulky free weights such a dumbbells, the disclosed adjustable lower body fitness devices use relatively compact weight increments that can be easily stacked and stored. As a result, using the disclosed adjustable lower body fitness devices there is no need to invest in, maintain, or store sets/racks of dumbbells or other space intensive weight systems in order to provide variable levels of workout and flexibility.

FIGS. 1, 2, 3, 4, 5, 6, 7, 8, and 9 are diagrams showing various perspectives and components of a disclosed adjustable lower body fitness device 100 that is one specific and non-limiting example of the disclosed adjustable lower body fitness devices. The specific illustrative example of a disclosed adjustable lower body fitness device 100 of FIGS. 1 through 9 is provided to illustrate the concepts set forth in claims below. However, those of skill in the art will readily recognize that—the specific illustrative examples of a disclosed adjustable lower body fitness devices shown in the FIGs. are possible and that the detailed description below does not purport to define or limit the invention to these specific illustrative examples. Rather, the invention is defined by the included claims.

Figure 2:
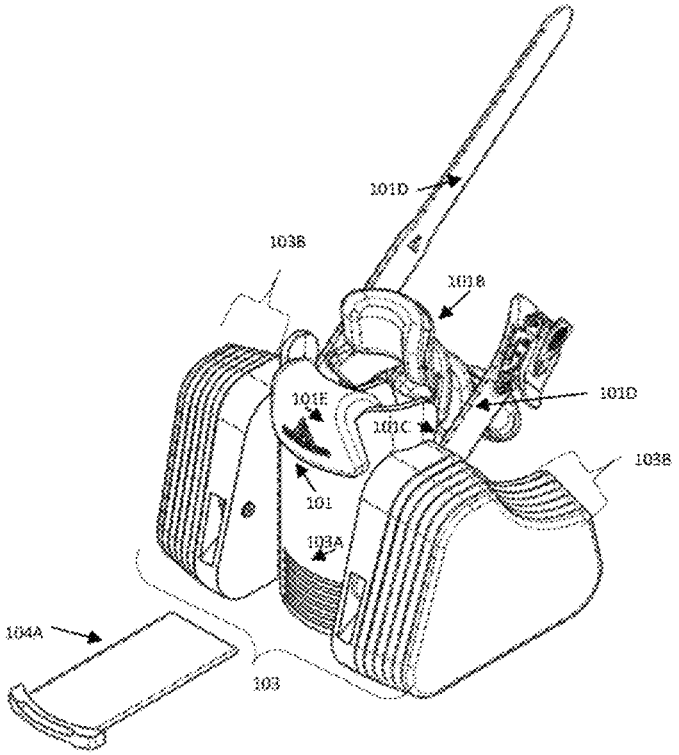
FIG. 2 is a diagram of a rear perspective view of the one specific example of FIG. 1 of the disclosed adjustable lower body fitness devices in accordance with one embodiment.
Figure 3:
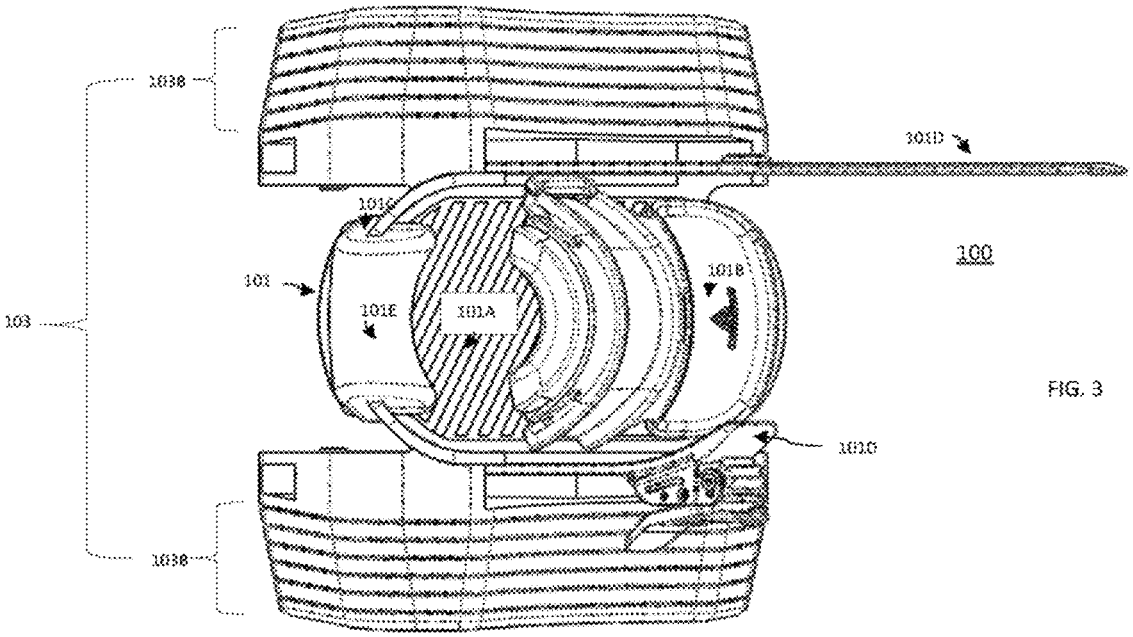
FIG. 3 is a diagram of a top view of the one specific example of FIG. 1 of the disclosed adjustable lower body fitness devices in accordance with one embodiment.
Figure 4:
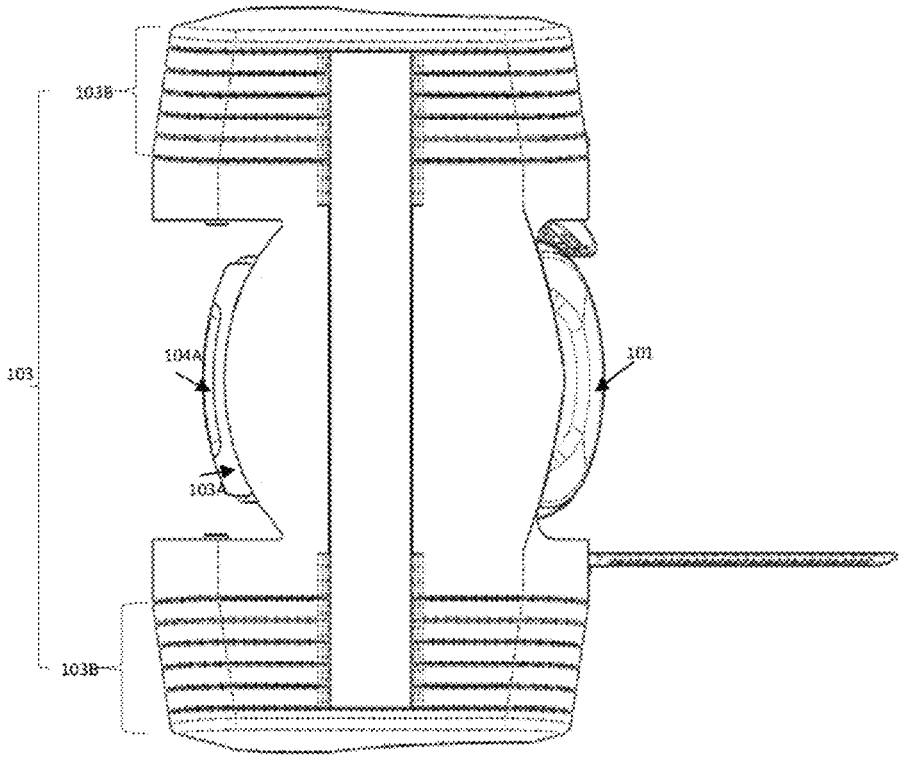
FIG. 4 is a diagram of a bottom view of the one specific example of FIG. 1 of the disclosed adjustable lower body fitness devices in accordance with one embodiment.
Figure 5:
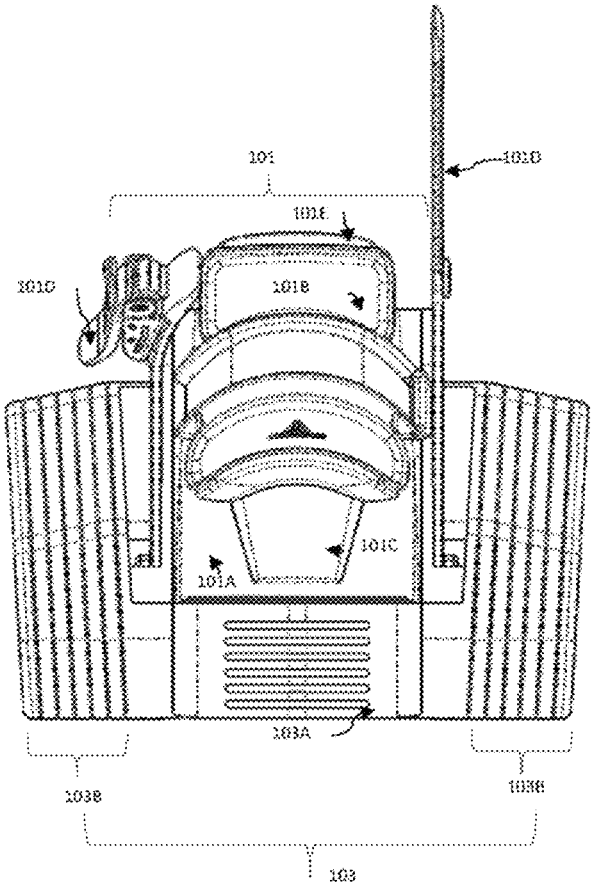
FIG. 5 is a diagram of a front view of the one specific example of FIG. 1 of the disclosed adjustable lower body fitness devices in accordance with one embodiment.
Figure 6:
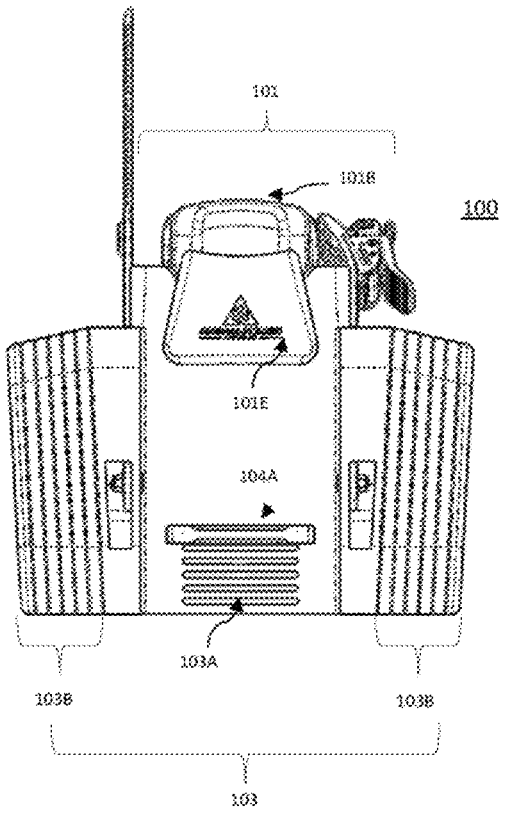
FIG. 6 is a diagram of a back view of the one specific example of FIG. 1 of the disclosed adjustable lower body fitness devices in accordance with one embodiment.
Figure 7:
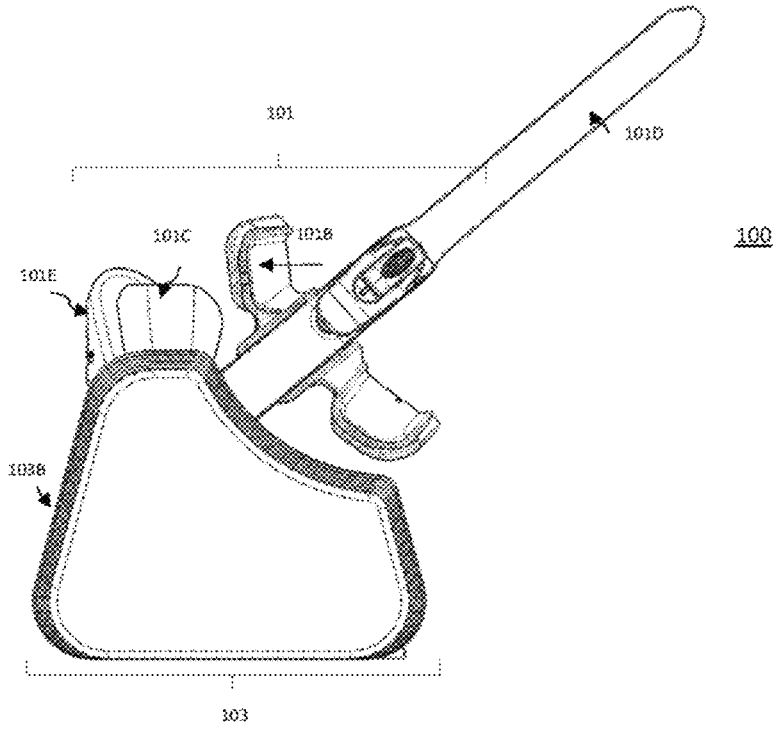
FIG. 7 is a diagram of a right side view of the one specific example of FIG. 1 of the disclosed adjustable lower body fitness devices in accordance with one embodiment.
Figure 8:
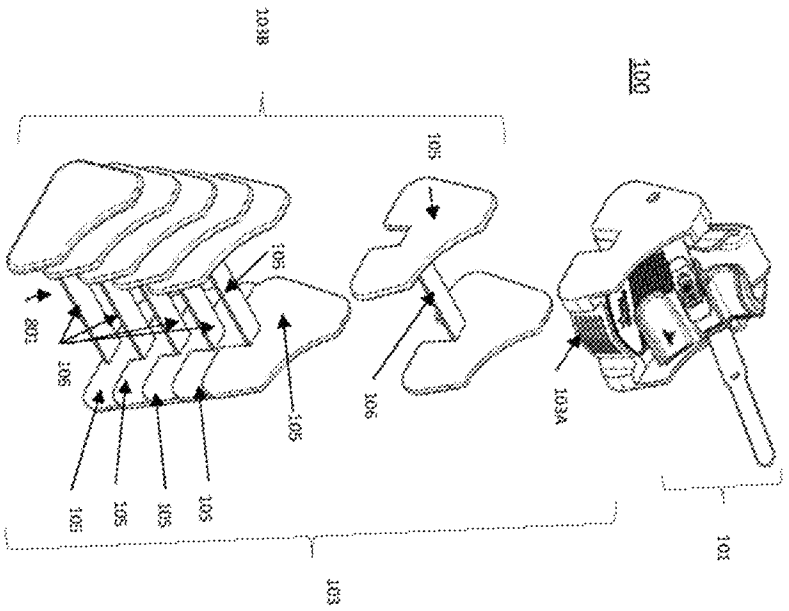
FIG. 8 is a diagram of an exploded perspective view of one specific example of the disclosed adjustable lower body fitness devices in accordance with one embodiment.
Figure 9:
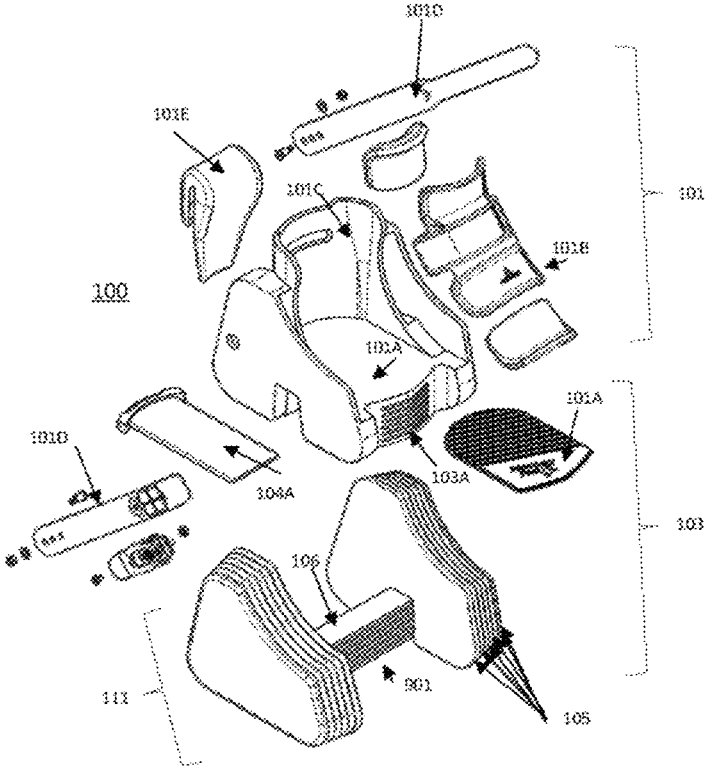
FIG. 9 is a diagram of an exploded perspective view showing various parts of one specific example of the disclosed adjustable lower body fitness devices including an adjustable lower body fitness device docking station in accordance with one embodiment.

Referring now to FIGS. 1 through 9:

FIG. 1 is a diagram of a front perspective view of one specific example of a disclosed adjustable lower body fitness device 100 in accordance with one embodiment;

FIG. 2 is a diagram of a rear perspective view of adjustable lower body fitness device 100 in accordance with one embodiment;

FIG. 3 is a diagram of a top view of adjustable lower body fitness device 100 in accordance with one embodiment;

FIG. 4 is a diagram of a bottom view of adjustable lower body fitness device 100 in accordance with one embodiment;

FIG. 5 is a diagram of a front view of adjustable lower body fitness device 100 in accordance with one embodiment;

FIG. 6 is a diagram of a back view of adjustable lower body fitness device 100 in accordance with one embodiment;

FIG. 7 is a diagram of a right side view of adjustable lower body fitness device 100 in accordance with one embodiment;

FIG. 8 is a diagram of an exploded perspective view of adjustable lower body fitness device 100 in accordance with one embodiment; and FIG. 9 is a diagram of an exploded perspective view showing various parts of adjustable lower body fitness device 100 in accordance with one embodiment, including an adjustable lower body fitness device docking station, in accordance with one embodiment.

Referring now to FIGS. 1 through 9 together, in one embodiment, adjustable lower body fitness device 100 includes body attachment portion 101 and adjustable weight portion 103 including a selected weight set 103B made up of one or more weight increments 105.

In one example, at least part of the adjustable lower body fitness device is manufactured through injection molding techniques.

In one embodiment, a user desiring to work their lower body uses body attachment portion 101 to attach adjustable lower body fitness device 100 to their foot/ankle. In one embodiment, body attachment portion 101 includes a base support portion 101A, with optional base pad 901A (shown most clearly in FIG. 9, 10A, 10B and 10C), lateral support portion 101C (shown most clearly in FIGS. 9, 10A, 10B and 10C), and front portion 101B (shown most clearly in FIGS. 9, 10A, 10B and 10C).

In one embodiment, lateral support portion 101C includes ankle support/cushion portion 101E.

Referring back to FIGS. 1 through 9 together, in one embodiment, the body attachment portion includes one or more strap mechanisms 101D used to secure the user's foot and/or ankle to adjustable lower body fitness device 100 by securing the user's foot and/or ankle to base support portion 101A and lateral support portion 101C of body attachment portion 101 of adjustable lower body fitness device 100.

In one embodiment, base support portion 101A includes a flat portion to accept at least part of the bottom of a user's foot. In one embodiment, lateral support portion 101C includes a cupping surface to accept at least a portion of the user's heel and/or ankle.

In one embodiment, one or more strap mechanisms 101D wrap around a portion of the user's lower foot. In one embodiment, the one or more strap mechanisms 101D include one or more hinges that press fit into respective openings of base support portion 101A and the lateral support portion 101C.

In one embodiment, the one or more strap mechanisms 101D are attached to the base support portion 101A using snap or press fit, mechanical fasteners, such as hook and loop, simple loop, tie buckles, clips, or any other suitable mechanism to attach the one or more strap mechanisms 101D to base support portion 101A.

In one embodiment, a user desiring to work their lower body uses body attachment portion 101 to attach adjustable lower body fitness device 100 to their foot/ankle using a base support portion 101A, lateral support portion 101C, and front portion 101B. In one embodiment, base support portion 101A includes a flat portion to accept at least part of the bottom of a user's foot. In one embodiment, lateral support portion 101C includes a cupping surface to accept at least a portion of the user's heel and/or ankle. In one embodiment, front portion 101B is designed to fit over at least a portion of front of the user's foot and/or ankle.

In one embodiment, body attachment portion 101 includes one or more strap mechanisms 101D used to secure the user's foot and/or ankle to adjustable lower body fitness device 100 by securing the user's foot and/or ankle in an adjustable space/cavity (see 1003 in FIGS. 10A, 10B, and 10C discussed in more detail below) formed by base support portion 101A, lateral support portion 101C, and front portion 101B of body attachment portion 101 of adjustable lower body fitness device 100.

Referring back to FIGS. 1 through 9 together, in one embodiment, the adjustable lower body fitness device 100 includes a body attachment portion 101 made up of base support portion 101A, lateral support portion 101C with ankle cushion portion 101E, a front portion 101B, and one or more strap mechanisms 101D.

In various embodiments, the body attachment portion can be any mechanism, as discussed herein, known in the art at the time of filing, and/or as developed/made available after the time of filing that allows a user to attach the adjustable lower body fitness device to their foot, ankle, or leg.

In one embodiment, it is expected the user will be wearing shoes such as tennis shoes or other workout shoes. Using the disclosed embodiments, any user shoes, or even a bare foot, of virtually any size, can be accommodated by body attachment portion 101 due to the adjustable design of body attachment portion 101.

As noted, in one embodiment, body attachment portion 101 includes one or more strap mechanisms 101D used to secure the user's foot and/or ankle to adjustable lower body fitness device 100 by securing the user's foot and/or ankle between an adjustable space/cavity formed by base support portion 101A, lateral support portion 101C, and front portion 101B of body attachment portion 101 of adjustable lower body fitness device 100.

In one embodiment, base support portion 101A and lateral support portion rotate 101C about one or more hinges. In one embodiment, the hinges are formed from metal, for example, aluminum, titanium, or steel, injection molded plastic, or any other suitable material. This feature allows the angle between base support portion 101A and lateral support portion rotate 101C to varied for ease of attachment and to accommodate different feet and/or shoes.

Consequently, using the disclosed embodiments, any user shoes, or even a bare foot, of virtually any size, can be accommodated by body attachment portion 101 due to the adjustable design of body attachment portion 101.

Figure 10A:
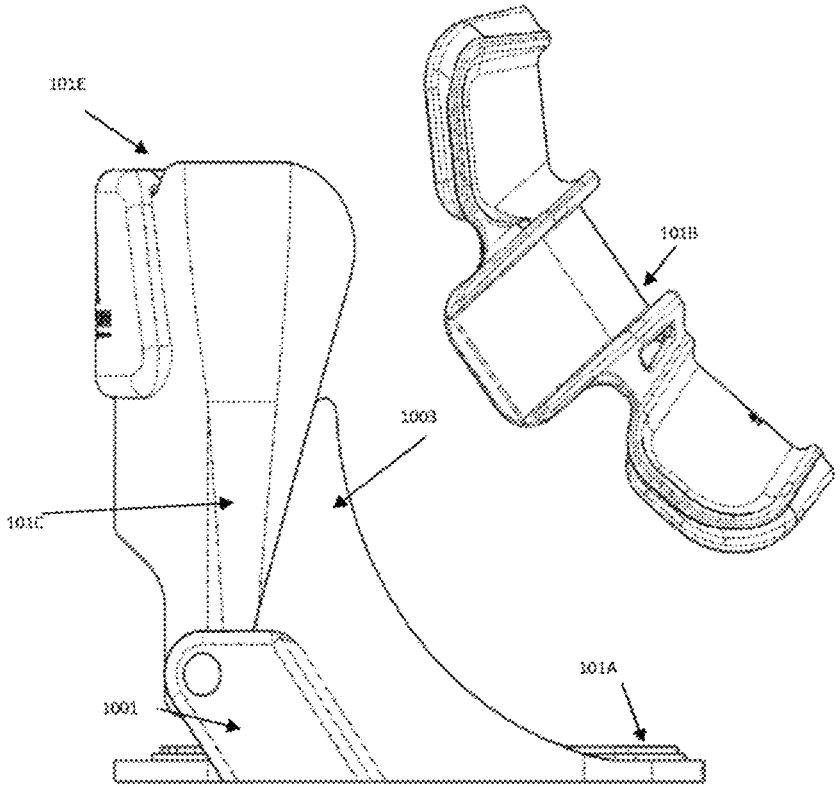
FIGS. 10A, 10B, and 10C are diagrams of the components of one specific illustrative embodiment of a body attachment portion of one specific example of the disclosed adjustable lower body fitness devices in accordance with one embodiment.
Figure 10B:
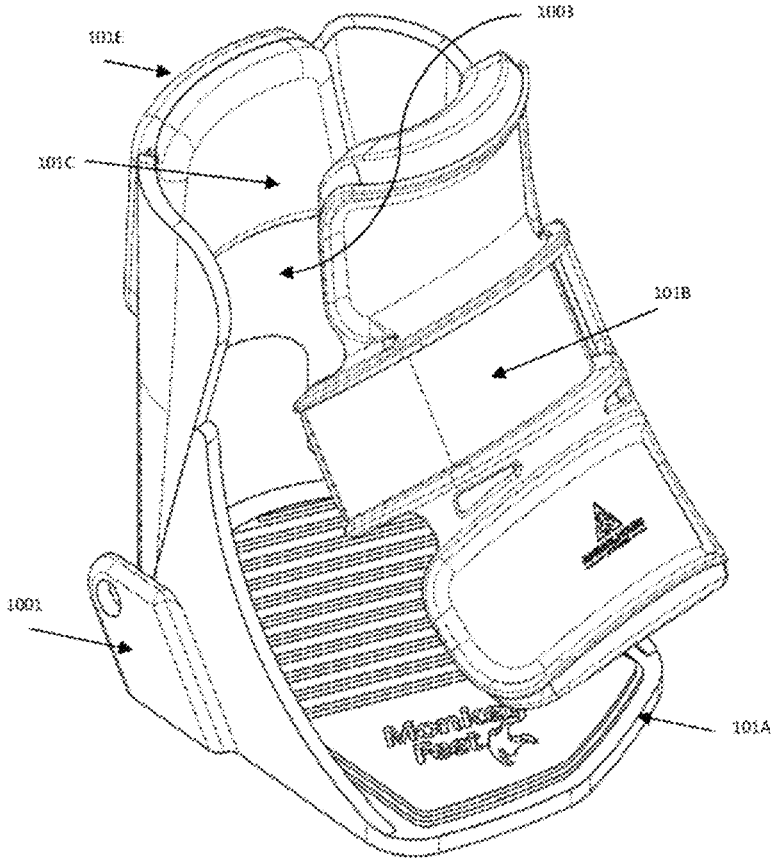
Figure 10C:
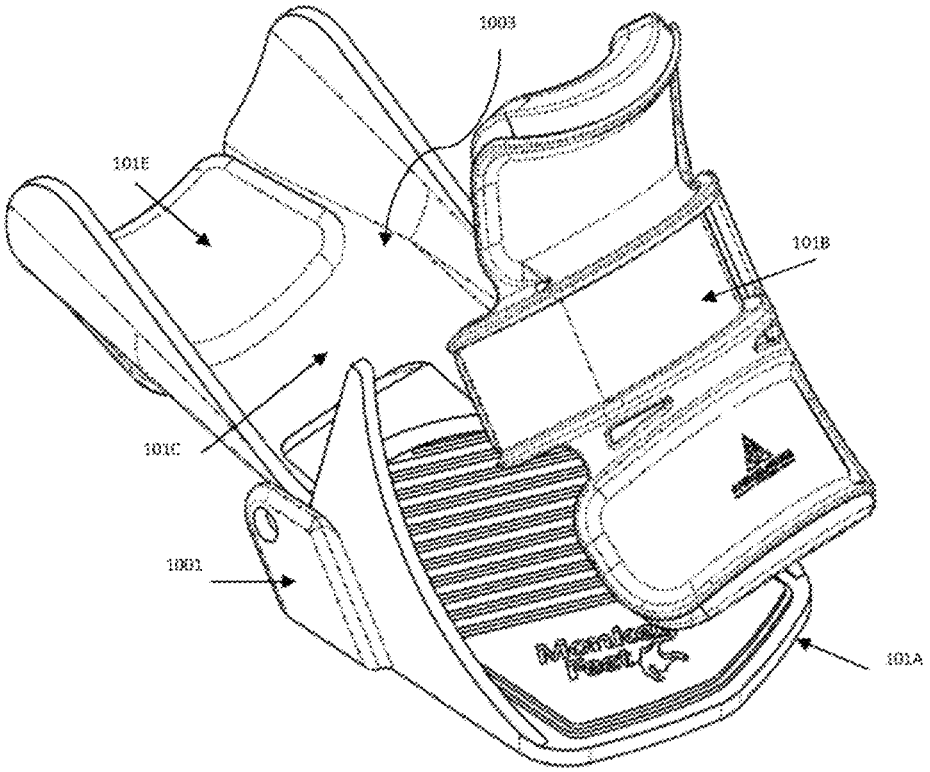

FIGS. 10A, 10B, and 10C illustrate one example of base support portion 101A, lateral support portion 101C, and front portion 101B. Shown in 10A, 10B, and 10C are base support portion 101A, lateral support portion 101C, with optional cushion 101E, front portion 101B, and hinge 1001 that form adjustable foot cavity 1003.

As seen in FIGS. 10A, 10B, and 10C the relative positions of base support portion 101A, lateral support portion 101C, and front portion 101B can be readily adjusted as needed to create an adjustable foot cavity 1003 that can accept and accommodate virtually any foot size and any shoe.

In addition, as noted, in one embodiment, base support portion 101A and lateral support portion 101C rotate about one or more hinges 1001. In one embodiment, hinges 1001 are formed from metal, for example, aluminum, titanium, or steel, injection molded plastic, or any other suitable material. This feature allows the angle between base support portion 101A and lateral support portion rotate 101C to varied for ease of attachment and to accommodate different feet and/or shoes.

Therefore, a single unit of the disclosed adjustable lower body fitness devices can be used by any number of users having any number of different foot sizes and/or shoe types. This eliminates the need to acquire and store multiple adjustable lower body fitness devices when there are multiple users contemplated, such as in the case of a gym environment or other multiple user environment such as a family home workout environment.

Referring back to FIGS. 1 through 9 together, when in use, a user's foot/shoe is positioned in body attachment portion 101 such that the bottom of the user's foot/shoe is positioned flatly on base support portion 101A with the back of the user's heel and ankle against lateral support portion 101C and ankle cushion portion 101E.

In one embodiment, once the user's foot is so positioned, front portion 101B is placed against the front of the user's foot and ankle such that the user's foot is positioned between base support portion 101A, lateral support portion 101C and front portion 101B. As noted, the adjustable foot cavity 1003

(see FIGS. 10A, 10B, and 10C) between base support portion 101A, lateral support portion 101C and front portion 101B can therefore be adjusted to accommodate virtually any foot size and any shoe.

In one embodiment, once the user's foot is positioned between base support portion 101A, lateral support portion 101C and front portion 101B, one or more strap mechanisms 101D are used to adjust and secure the user's foot between base support portion 101A, lateral support portion 101C and front portion 101B and body attachment portion 101 is thereby securing attached to the user's foot and locked in place using the one or more strap mechanisms 101D.

As noted, using the disclosed embodiments of body attachment portion 101, including adjustable lower body fitness device 100, a single adjustable lower body fitness device 100 can be used by numerous users having virtually any foot size and any shoe. Consequently, there is no need to acquire of store numerous adjustable lower body fitness device 100 to accommodate different users.

In one embodiment, adjustable lower body fitness device 100 also includes adjustable weight portion 103. In one embodiment, adjustable weight portion 103 is attached to, and/or is an integrally formed part of, body attachment portion 101. In this way, when the user attaches body attachment portion 101 to attach the adjustable lower body fitness device 100 to their foot, ankle, and/or leg, the adjustable weight portion 103 is also attached to the user's foot, ankle, and/or leg such that the entire adjustable lower body fitness device 100, including the body attachment portion 101 and the adjustable weight portion 103, becomes an attached extension of the user's leg.

Figure 13:
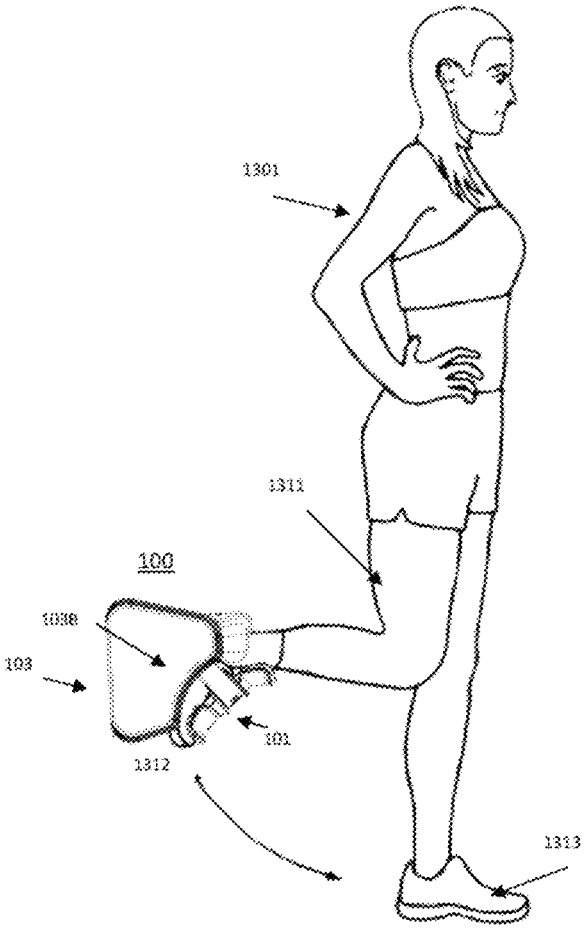
FIG. 13 is a diagram of a perspective view showing how a user might perform exercises using one specific example of the disclosed adjustable lower body fitness devices to perform hamstring curls.
Figure 14:
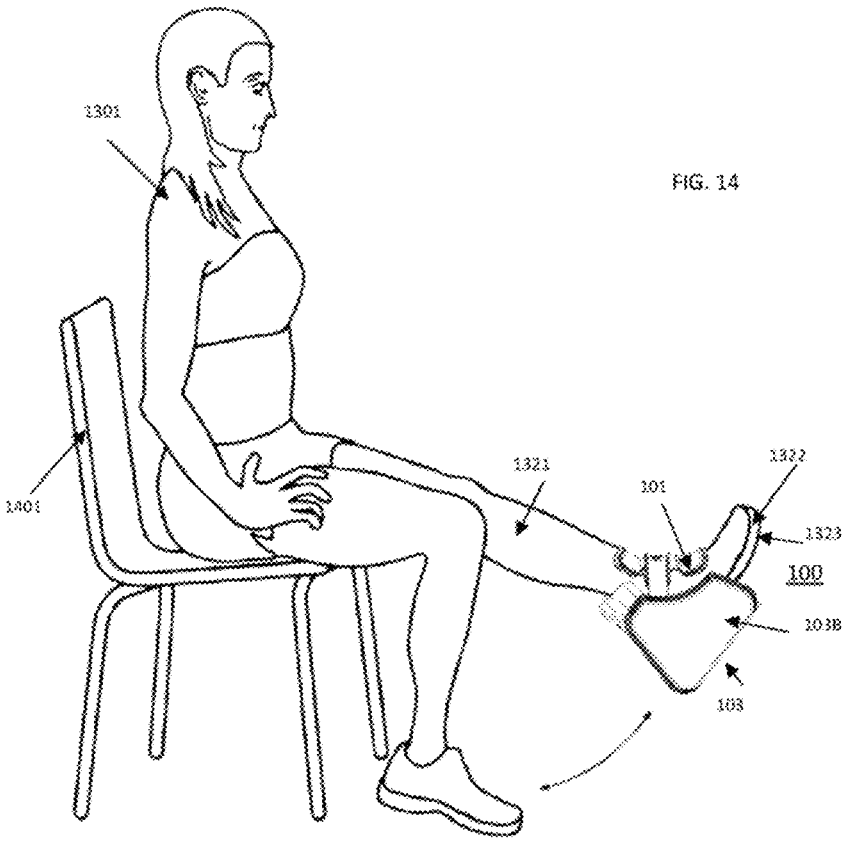
FIG. 14 is a diagram of a perspective view showing how a user might perform exercises using one specific example of the disclosed adjustable lower body fitness devices to perform leg extensions.

Of note is the fact that since the disclosed adjustable lower body fitness devices 100 are attached as an extension of the user's foot/leg, the disclosed adjustable lower body fitness devices 100 allow for freedom of movement and a variety of positions not available using traditional leg lift machines or other prior art systems. This fact makes it easier to obtain more complete lower body workouts that address more muscle groups and help balance overall strength conditioning. This feature is illustrated in FIGS. 13 and 14 and discussed in more detail below.

Likewise, due to their small size and that they are an extension of the user's foot/leg, the disclosed adjustable lower body fitness devices 100 can lend themselves to group training/classes when that is desired. In these instances, each user is able to adjust their own weight level and therefore customize their workout to their needs/skills.

Referring back to FIGS. 1 through 9 together, in one embodiment, adjustable weight portion 103 includes selected weight set 103B made up of one or more weight increments 105 that together make up the adjustable amount of weight included on adjustable weight portion 103. In one embodiment, the number of weight increments 105 included in the selected weight set 103B of adjustable weight portion 103 is selected by the user by adding or subtracting weight increments 105 to achieve a desired total weight of the adjustable weight portion 103.

In various embodiments, weight increments 105 are formed from metal, for example, aluminum, titanium, or steel; injection molded plastic; ceramics, concrete, or any other suitable material as discussed herein, known in the art at the time of filing, and/or as developed/made available after the time of filing, that can be used to create/provide a weight increment.

In various embodiments, weight increments 105 are formed in any one of numerous shapes, sizes, and orientations to meet the needs of a specific embodiment and, in one embodiment, to make weight increments 105 stackable and/or usable with various adjustable lower body fitness devices and adjustable lower body fitness device docking stations.

Figure 11:
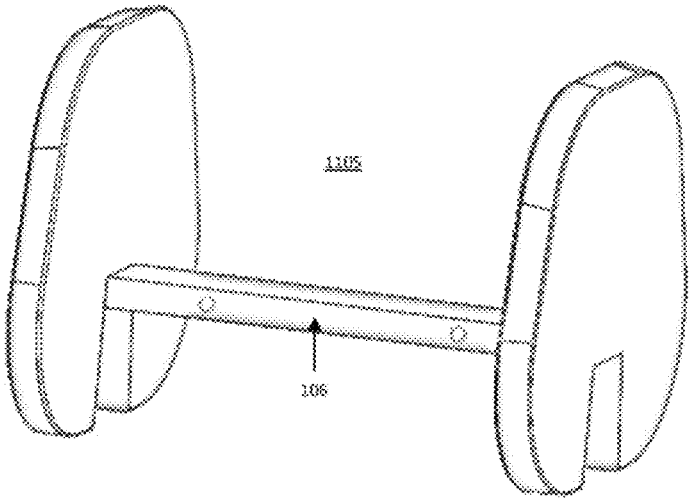
FIG. 11 is a diagram of one specific example of a weight increment that can be used with one or more embodiments of the disclosed adjustable lower body fitness devices in accordance with one embodiment.
Figure 12:
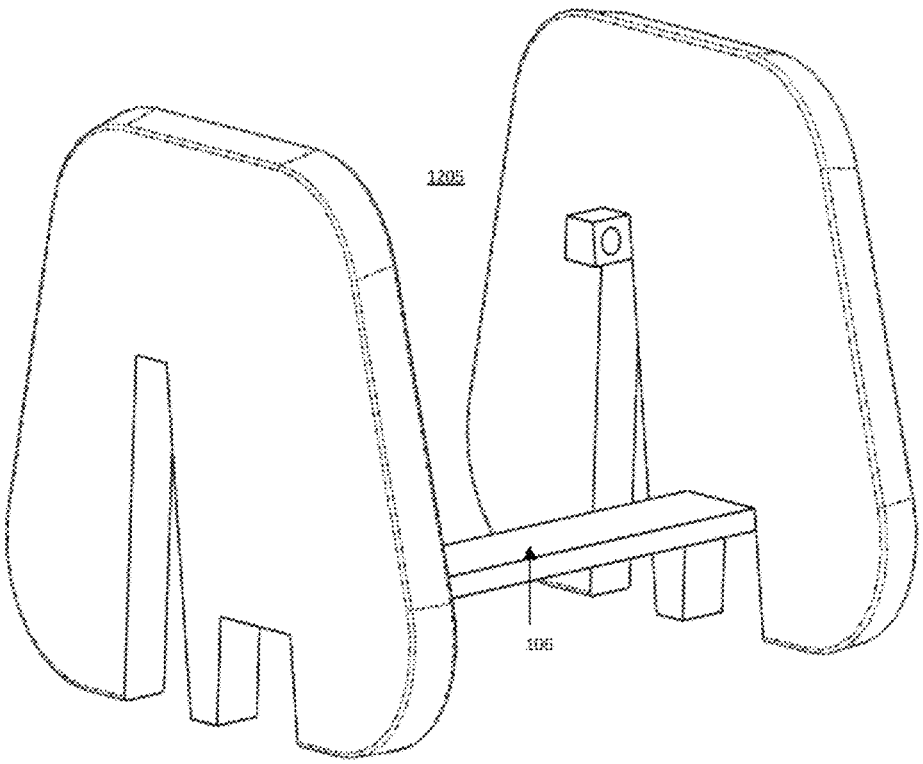
FIG. 12 is a diagram of another specific example of a weight increment that can be used with one or more embodiments of the disclosed adjustable lower body fitness devices in accordance with one embodiment.

As specific illustrative examples, FIG. 11 is a diagram of one specific example of a weight increment 1105 that can be used with one or more embodiments of the disclosed adjustable lower body fitness devices in accordance with one embodiment. Likewise, FIG. 12 is a diagram of another specific illustrative examples of a weight increments 1205 that can be used with one or more embodiments of the disclosed adjustable lower body fitness devices in accordance with one embodiment. In addition, FIGS. 15, 16, and 17, discussed in more detail below, show other specific illustrative examples of a weight increments 1505. 1605, and 1705, respectively, that can be used with one or more embodiments of the disclosed adjustable lower body fitness devices in accordance with various embodiments.

In various embodiments, the disclosed weight increments can be formed into any shape desired including shapes discussed herein, known in the art at the time of filing, and/or as developed/made available after the time of filing, that can be combined to provide a selected weight set of a desired overall weight.

In various embodiments, the number of weight increments 105 needed to provide the desired weight of a selected weight set 103B are selected and combined, e.g., stacked/attached and/or otherwise combined, using one of several types of weight increment attachment mechanisms and/or weight selection mechanisms.

As one example, and as discussed in more detail below, the weight increment attachment mechanism for adding or subtracting weight increments making up the selected weight set 103B of adjustable weight portion 103 can be a slot 103A and selection plate 104A system as shown in FIGS. 1 through 9 and discussed in more detail below.

As another example, the weight increment attachment mechanism for adding or subtracting weight increments 105 making up the selected weight set 103B of adjustable weight portion 103 can be more or more commonly available hole and pin mechanism such as those used with the weight stacks of prior art lower body fitness systems.

As another example, the weight increment attachment mechanism for adding or subtracting weight increments 105 making up the selected weight set 103B of adjustable weight portion 103 can be one or more commonly available screw and bolt type weight increment attachment mechanism such as those used with some prior art barbell and dumbbell systems.

As another example, the weight increment attachment mechanism for adding or subtracting weight increments 105 making up the selected weight set 103B of adjustable weight portion 103 can be a hook and loop, or similar, attachable and detachable weight increment attachment mechanism.

As another example, the weight increment attachment mechanism for adding or subtracting weight increments 105 making up the selected weight set 103B of adjustable weight portion 103 can be a slot and groove weight increment attachment mechanism.

As another example, the weight increment attachment mechanism for adding or subtracting weight increments 105 making up the selected weight set 103B of adjustable weight portion 103 can a magnet-based weight increment attachment mechanism.

As another example, the weight increment attachment mechanism for adding or subtracting weight increments 105 making up the selected weight set 103B of adjustable weight portion 103 can a simple strap weight increment attachment mechanism.

In various embodiments, the weight increment attachment mechanism for adding or subtracting weight increments making up the selected weight set 103B of adjustable weight portion 103 can be any weight increment attachment mechanism as discussed herein, and/or as known in the art at the time of filing, and/or as developed after the time of filing that allows for the temporary and adjustable addition or subtraction of weight increments making up the adjustable weight portion.

In the illustrative embodiment of FIGS. 1 through 9, the weight increment attachment mechanism for adding or subtracting weight increments 105 making up the selected weight set 103B of adjustable weight portion 103 is a slot and selection plate system 103A/104A. In this particular example of one embodiment, the user positions the adjustable lower body fitness device 100 on a stack of weight increments 105 (see 801 or 901 of FIG. 8 or 9).

The user then selects the desired weight of selected weight set 103B by inserting the selection plate portion 104A of slot and selection plate system 103A/104A into the corresponding slot 103A of slot and selection plate system 103A/104A. In one embodiment, each slot corresponds to a weight selection portion of a specific weight increment, such as crossbar portion 106, of a unique one of weight increments 105. Consequently, each slot 103A of slot and selection plate system 103A/104A corresponds to a unique number, or sub-set, of weight increments 105 to be attached to adjustable weight portion 103 and therefore each slot 103A of slot and selection plate system 103A/104A corresponds to a unique total weight for selected weight set 103B of adjustable weight portion 103. In this way, the weight of adjustable weight portion 103, and adjustable lower body fitness device 100, can be readily and easily selected and/or changed.

As shown in FIG. 9, the weight increment attachment mechanism for adding or subtracting weight increments making up the selected weight set 103B of adjustable weight portion 103 can include an adjustable lower body fitness device docking station 111. In one embodiment, the adjustable lower body fitness device docking station 111 includes a set or sub-set of the weight increments 105 available to be combined and attached to the adjustable weight portion 103 to form a selected weight set 103B of the desired weight that is attached to, and temporarily becomes part of, adjustable lower body fitness device 100.

Referring to FIG. 9, in one embodiment, the adjustable lower body fitness device docking station 111 is designed to receive adjustable lower body fitness device 100, including adjustable weight portion 103. In one embodiment, once the adjustable lower body fitness device 100 is positioned in the adjustable lower body fitness device docking station 111, the user can select the desired total weight of selected weight set 103B for the adjustable weight portion 103 of the adjustable lower body fitness device 100 using one of the weight selection mechanisms, such as the slot and selection plate system 103A/104A shown in FIGS. 8 and 9. In one embodiment, once the user selects the desired weight of selected weight set 103B, the number of weight increments 105 needed to achieve the desired total weight for the adjustable weight portion 103 of the adjustable lower body fitness device 100 are selected and temporarily attached to the adjustable weight portion 103 of the adjustable lower body fitness device 100.

Various forms of device docking stations as described above are known in the art, consequently, a more detailed description of any particular device docking stations is omitted here to avoid detracting from the invention.

Figure 16:
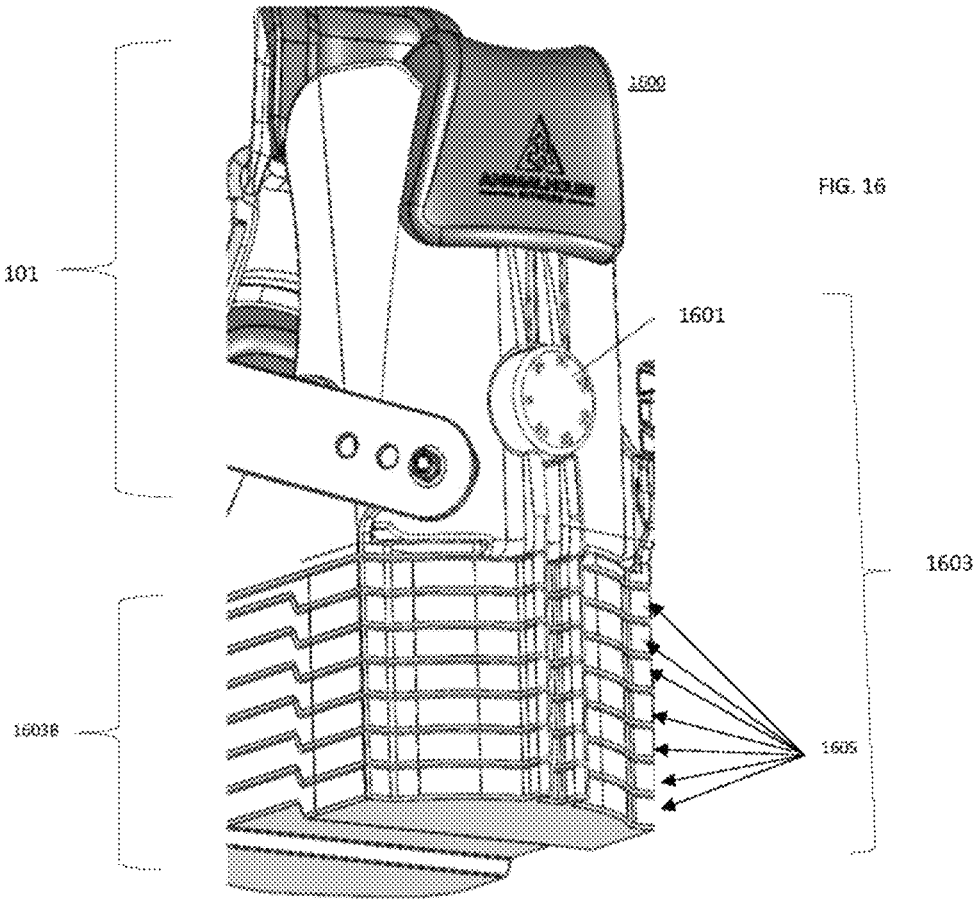
FIG. 16 is a diagram of rear perspective view of the one specific example of FIG. 15 of the disclosed adjustable lower body fitness devices, including one specific illustrative example of a knob-based weight selection mechanism in accordance with one embodiment.

In some embodiments, the weight increment attachment mechanism for adding or subtracting weight increments making up the selected weight set 103B of adjustable weight portion 103 includes a knob style weight selection mechanism. As one illustrative example, FIG. 16 is a diagram of rear perspective view of the disclosed adjustable lower body fitness devices, including one specific illustrative example of a knob style weight selection mechanism 1601 in accordance with one embodiment.

Various forms of knob style weight selection mechanisms as described above are known in the art, consequently, a more detailed description of any particular weight selection mechanisms is omitted here to avoid detracting from the invention.

Referring back to FIGS. 1 through 9 together, in various embodiments, the weight increment attachment mechanism and/or weight selection mechanism for adding or subtracting weight increments 105 making up the selected weight set 103B of adjustable weight portion 103 can be any weight increment attachment mechanism and/or weight selection mechanism as discussed herein, and/or as known in the art at the time of filing, and/or as developed after the time of filing that allows for the temporary and adjustable addition or subtraction of weight increments making up the adjustable weight portion.

As discussed above, in contrast to adjustable lower body fitness devices that rely on the use of expensive and bulky free weights such a dumbbells, the disclosed adjustable lower body fitness devices 100 use relatively compact weight increments 105 that can be easily stacked and stored (see 801 and 901 of FIGS. 8 and 9). As a result, using the disclosed adjustable lower body fitness devices 100 there is no need to invest in, and maintain, racks of dumbbells or other space intensive weight systems in order to provide variable levels of workout and flexibility.

FIGS. 13 and 14 are diagrams of FIG. 13 of a perspective views showing how a user might perform exercises using one specific example of the disclosed adjustable lower body fitness devices.

As seen in FIG. 13, a user 1301 performs hamstring curls using adjustable lower body fitness device 100, thereby exercising leg 1311. As shown, foot 1312 is secured within the adjustable lower body fitness device 100. In this example, user 1301 is wearing footwear 1313. However, as noted, adjustable lower body fitness device 100 can be operated with or without footwear 1313.

As seen in FIG. 14, user 1301 is seated on chair 1401 and performs leg extensions using adjustable lower body fitness device 100, thereby exercising leg 1321. As shown, foot 1322 is secured within the adjustable lower body fitness device 100. In this example, user 1301 is wearing footwear 1323. However, as noted, adjustable lower body fitness device 100 can be operated with or without footwear 1323.

As noted above, FIGS. 1, 2, 3, 4, 5, 6, 7, 8, and 9 are diagrams showing various perspectives and components of a disclosed adjustable lower body fitness device 100 that is one specific and non-limiting example of the disclosed adjustable lower body fitness devices. The specific illustrative example of a disclosed adjustable lower body fitness device 100 of FIGS. 1 through 9 is provided to illustrate the concepts set forth in claims below. However, those of skill in the art will readily recognize that numerous variations of the specific illustrative examples of a disclosed adjustable lower body fitness devices shown in the FIGs. are possible and that the detailed description below does not purport to define or limit the invention to these specific illustrative examples. Rather, the invention is defined by the included claims.

Figure 15:
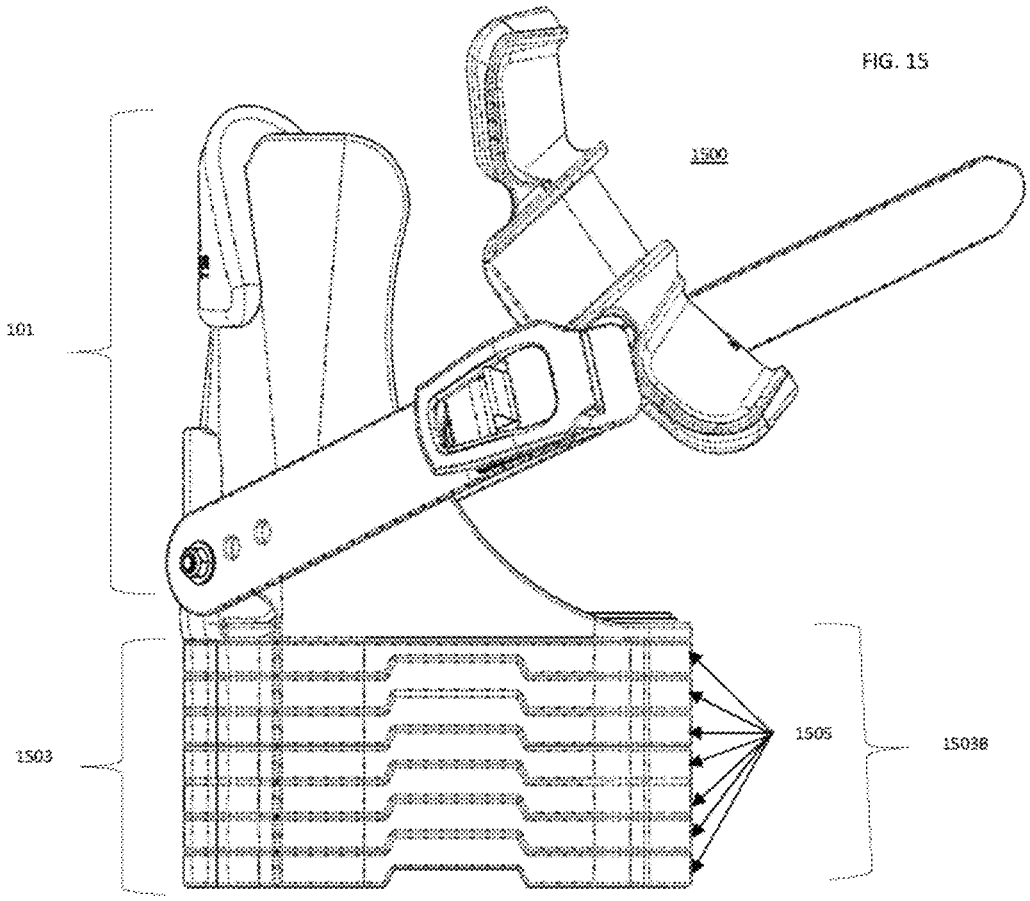
FIG. 15 is a diagram of right view of another specific example of the disclosed adjustable lower body fitness devices, in accordance with one embodiment.

As an example, FIG. 15 is a diagram of right side view of another specific example of the disclosed adjustable lower body fitness devices, in accordance with one embodiment. Shown in FIG. 15 is adjustable lower body fitness device 1500 including the body attachment portion 101 discussed above with respect to FIGS. 1 though 9. In addition, lower body fitness device 1500 includes adjustable weight portion 1503 including selected weight set 1503B. As also seen in FIG. 15, selected weight set 1503B includes horizontally orientated weight increments 1505.

Similarly, FIG. 16 is a diagram of right side view of another specific example of the disclosed adjustable lower body fitness devices, in accordance with one embodiment. Shown in FIG. 16 is adjustable lower body fitness device 1600 including the body attachment portion 1601 discussed above with respect to FIGS. 1 through 9. In addition, lower body fitness device 1600 includes adjustable weight portion 1603 including selected weight set 1603B. As also seen in FIG. 16, selected weight set 1603B includes horizontally orientated weight increments 1605 and a knob-style weight selection mechanism 1601.

Figure 17:
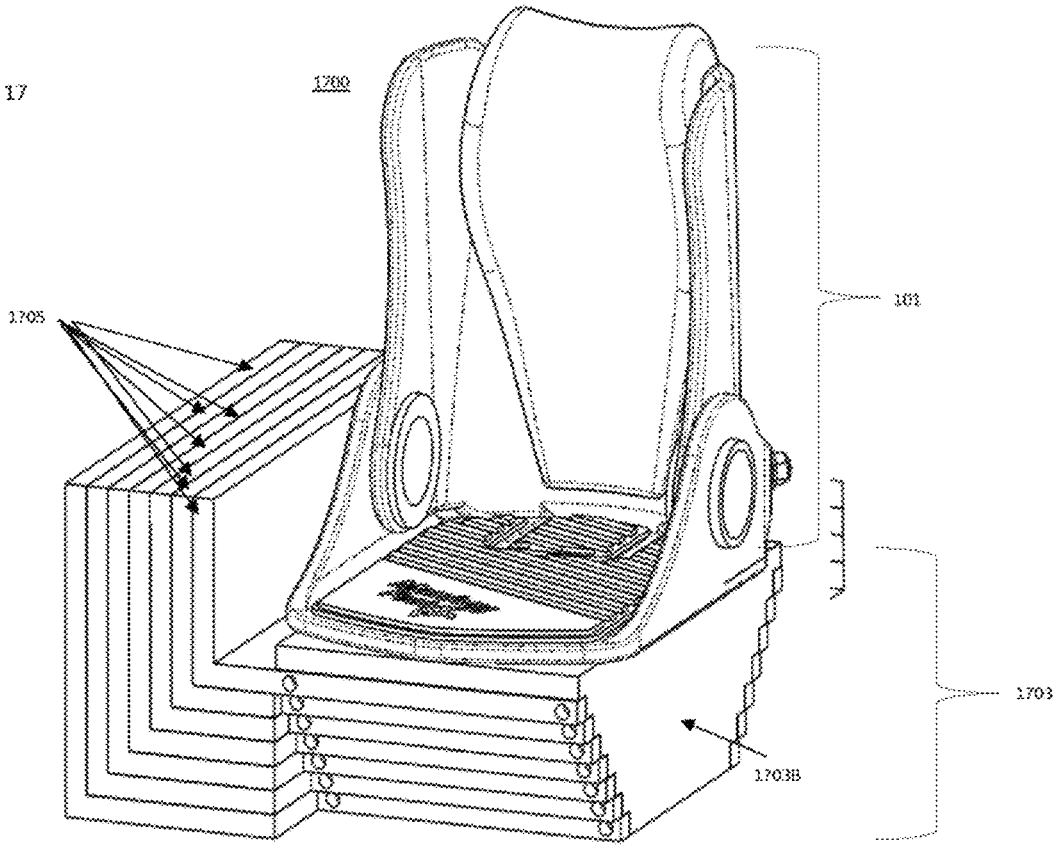
FIG. 17 is a diagram of right view of another specific example of the disclosed adjustable lower body fitness devices, in accordance with one embodiment.

As another example, FIG. 17 is a diagram of right side view of another specific example of the disclosed adjustable lower body fitness devices, in accordance with one embodiment. Shown in FIG. 17 is adjustable lower body fitness device 1700 including the body attachment portion 101 discussed above with respect to FIGS. 1 though 9. In addition, lower body fitness device 1700 includes adjustable weight portion 1703 including selected weight set 1703B. As also seen in FIG. 17, selected weight set 1703B includes side orientated weight increments 1705.

As can be seen, and as noted above, numerous variations of the specific illustrative examples of a disclosed adjustable lower body fitness devices shown in the FIGs. are possible and that the detailed description below does not purport to define or limit the invention to these specific illustrative examples. Rather, the invention is defined by the included claims.

Figure 18:
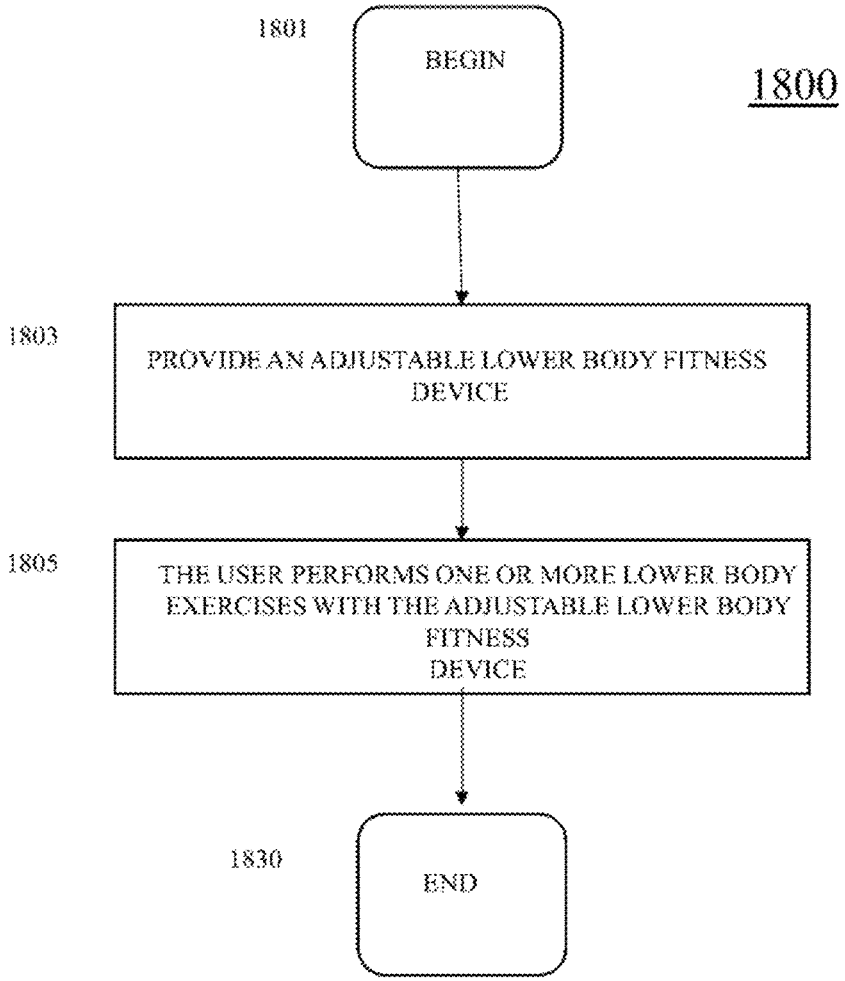
FIG. 18 is a flowchart of a method in accordance with one embodiment.

FIG. 18 is a flowchart of a method 1800 in accordance with one embodiment. Referring to FIG. 18 and FIGS. 1 through 17 together, in one embodiment, method 1801 begins at 1801 and proceeds to 1803.

In one embodiment, at 1803 an adjustable lower body fitness device, such as adjustable lower body fitness device 100 is provided. The method then proceeds to 1805.

In one embodiment, at 1805, the user performs one or more lower body exercises using the adjustable lower body fitness device, such as adjustable lower body fitness device 100.

In one embodiment, once the user performs one or more lower body exercises using the adjustable lower body fitness device, such as adjustable lower body fitness device 100, the method is exited to await a new user and/or a new exercise session at 1830.

Figure 19:
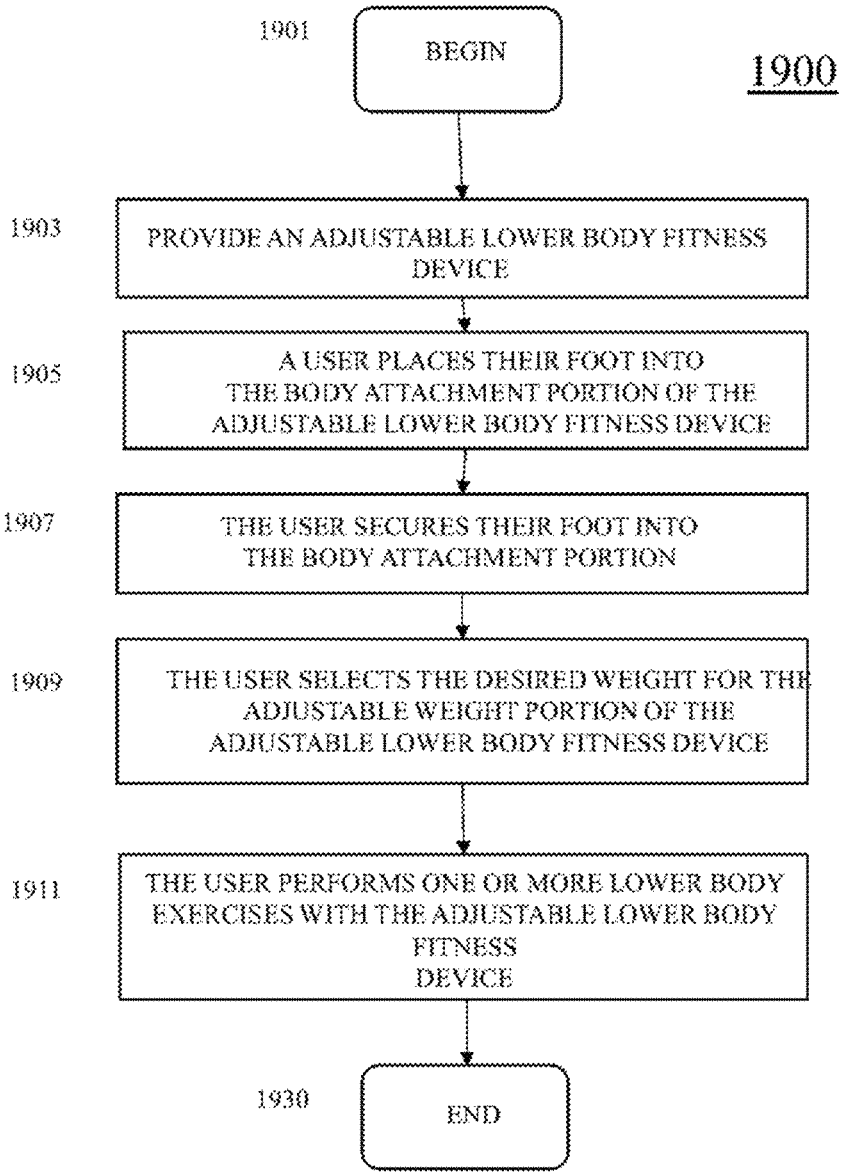
FIG. 19 is a flowchart of another method in accordance with one embodiment.

FIG. 19 is a flowchart of a method 1900 in accordance with one embodiment. Referring to FIG. 19 and FIGS. 1 through 17 together, in one embodiment, method 1901 begins at 1901 and proceeds to 1903.

In one embodiment, at 1903 an adjustable lower body fitness device, such as adjustable lower body fitness device 100 is provided. The method then proceeds to 1905.

In one embodiment, at 1905 a user places their foot into a body attachment portion, such as body attachment portion 101, of an adjustable lower body fitness device, such as adjustable lower body fitness device 100. The method then proceeds to 1907.

In one embodiment, at 1907 the user secures their foot into a body attachment portion, such as body attachment portion 101, of an adjustable lower body fitness device, such as adjustable lower body fitness device 100, using any of the methods or mechanisms described herein. The method then proceeds to 1909.

In one embodiment, at 1909, the user selects the desired weight of a weight stack, such as selected weight set 103B, of an adjustable weight portion, such as adjustable weight portion 103, of an adjustable lower body fitness device, such as adjustable lower body fitness device 100, using any of the methods and processes described herein. The method then proceeds to 1911.

At 1911, the user performs one or more lower body exercises using the adjustable lower body fitness device, such as adjustable lower body fitness device 100.

In one embodiment, once the user performs one or more lower body exercises using the adjustable lower body fitness device, such as adjustable lower body fitness device 100, the method is exited at 1930 to await a new user and/or a new exercise session.

Although certain specific exemplary embodiments are described above in order to illustrate the invention, the invention is not limited to the specific embodiments. Accordingly, various modifications, adaptations, and combinations of various features of the described embodiments can be practiced without departing from the scope of the invention as set forth in the claims. In particular, those of skill in the art will readily recognize that numerous variations of the specific illustrative examples of a disclosed adjustable lower body fitness devices shown in the FIGs. are possible and that the detailed description below does not purport to define or limit the invention to these specific illustrative examples. Rather, the invention is defined by the included claims.

As discussed above, embodiments of the present disclosure provide a technical solution to the long-standing technical problem of providing a method and system that allows users to effectively and efficiently exercise their lower body and core while also providing flexibility, minimal floor space/storage requirements, simplicity, relatively low cost, and minimal maintenance requirements. In various embodiments, this is accomplished by providing an adjustable lower body fitness device that is designed to attach to the users foot and thereby become an extension of the user's leg. In various embodiments, the disclosed adjustable lower body fitness device includes a body attachment portion and an adjustable weight portion that can be adjustably set to a desired weight by adding or subtracting relatively small form weight increments.

In one embodiment, the adjustable lower body fitness device includes: a body attachment portion configured to be attachable to and detachable from a foot of a user; an adjustable weight portion, the adjustable weight portion being attached to the body attachment portion of the adjustable lower body fitness device such that when the body attachment portion of the adjustable lower body fitness device is attached to a foot of a user, the adjustable weight portion becomes an extension of the user's leg, the adjustable weight portion including a weight increment attachment mechanism; and one or more weight increments, the one or more weight increments being attachable to and detachable from the adjustable weight portion using the adjustable weight portion weight increment attachment mechanism such that a total weight of the adjustable weight portion of the adjustable lower body fitness device can be adjusted by attaching or detaching one or more of the one or more weight increments.

In one embodiment, the body attachment portion of the adjustable lower body fitness device includes a first, or base portion flat surface, and a second, or lateral support surface configured such that when the body attachment portion is attached to the user's foot the first surface supports a bottom of the user's foot and the second surface supports a rear of the user's foot.

In one embodiment, the body attachment portion of the adjustable lower body fitness device is configured to be attached to footwear within which the user's foot is disposed such that when the body attachment portion is attached to the user's foot the first surface is configured to contact a sole of the footwear and the second surface is configured to contact a rear of the footwear.

In one embodiment, the body attachment portion of the adjustable lower body fitness device is configured such that the first surface and the second surface are substantially perpendicular with the first surface being substantially flat and the second surface being curved.

In one embodiment, the body attachment portion of the adjustable lower body fitness device includes at least one strap mechanism configured to secure the user's foot to the body attachment portion.

In one embodiment, the weight increment attachment mechanism of the body attachment portion of the adjustable lower body fitness device for attaching and detaching weight increments making up the adjustable weight portion is a slot and selection plate weight increment attachment mechanism.

In one embodiment, the weight increment attachment mechanism of the body attachment portion of the adjustable lower body fitness device for attaching and detaching weight increments making up the adjustable weight portion is a hole and pin weight increment attachment mechanism.

In one embodiment, the weight increment attachment mechanism of the body attachment portion of the adjustable lower body fitness device for attaching and detaching weight increments making up the adjustable weight portion is a screw and bolt weight increment attachment mechanism.

In one embodiment, the weight increment attachment mechanism of the body attachment portion of the adjustable lower body fitness device for attaching and detaching weight increments making up the adjustable weight portion is a hook and loop weight increment attachment mechanism.

In one embodiment, the weight increment attachment mechanism of the body attachment portion of the adjustable lower body fitness device for attaching and detaching weight increments making up the adjustable weight portion is a magnet-based weight increment attachment mechanism.

In one embodiment, the weight increment attachment mechanism of the body attachment portion of the adjustable lower body fitness device for attaching and detaching weight increments making up the adjustable weight portion is a slot and groove attachment weight increment attachment mechanism.

In one embodiment, the adjustable lower body fitness device includes: a body attachment portion configured to be attachable to and detachable from a foot of a user; an adjustable weight portion, the adjustable weight portion being attached to the body attachment portion of the adjustable lower body fitness device such that when the body attachment portion of the adjustable lower body fitness device is attached to a foot of a user the adjustable weight portion becomes an extension of the user's leg, the adjustable weight portion including a weight increment attachment mechanism; one or more weight increments, the one or more weight increments being attachable to and detachable from the adjustable weight portion using the adjustable weight portion weight increment attachment mechanism such that a total weight of the adjustable weight portion of the adjustable lower body fitness device can be adjusted by attaching or detaching one or more of the one or more weight increments; and an adjustable lower body fitness device docking station, the adjustable lower body fitness device docking station including at least some of the weight increments to be combined and attached to the adjustable weight portion of the lower body weight training fitness device, the adjustable lower body fitness device docking station configured to receive the lower body weight training fitness device, including the adjustable weight portion wherein when the lower body weight training fitness device is positioned in the adjustable lower body fitness device docking station the user can select the desired total weight for the adjustable weight portion of the lower body weight training fitness device the weight selection mechanism.

In one embodiment, a method for lower body exercise includes providing an adjustable lower body fitness device. In one embodiment, the adjustable lower body fitness device provided includes: a body attachment portion configured to be attachable to and detachable from a foot of a user; an adjustable weight portion, the adjustable weight portion being attached to the body attachment portion of the adjustable lower body fitness device such that when the body attachment portion of the adjustable lower body fitness device is attached to a foot of a user the adjustable weight portion becomes an extension of the user's leg, the adjustable weight portion including a weight increment attachment mechanism; and one or more weight increments, the one or more weight increments being attachable to and detachable from the adjustable weight portion using the adjustable weight portion weight increment attachment mechanism such that a total weight of the adjustable weight portion of the adjustable lower body fitness device can be adjusted by attaching or detaching one or more of the one or more weight increments.

In one embodiment, a method for lower body exercise further includes a user performing one or more lower body exercises while the adjustable lower body fitness device is attached to the user's foot by the body attachment portion of the adjustable lower body fitness device.

As seen above, the disclosed adjustable lower body fitness devices are simple, have few moving parts, require minimal floor space, are flexible, and can be made available at a relatively low price. Consequently, the disclosed adjustable lower body fitness devices are ideal for home use, or anywhere that minimizing complexity of equipment and required floor space is desirable. As noted, this is highly desirable in a world of pandemics, working from home, variable and unpredictable hours, and a general desire for privacy and convenience when working out.

In addition, since the disclosed adjustable lower body fitness devices are attached as an extension of the user's foot/leg, the disclosed adjustable lower body fitness devices allow for freedom of movement and a variety of positions not available using traditional leg lift machines or other prior art systems. As noted above, this fact makes it easier to obtain more complete lower body workouts that address more muscle groups and help balance overall strength conditioning.

Likewise, due to their small size and that they are an extension of the user's foot/leg, the disclosed adjustable lower body fitness devices can lend themselves to group training/classes when that is desired. In these instances, each user is able to adjust their own weight level and therefore customize their workout to their needs/skills.

In addition, in contrast to adjustable lower body fitness devices that rely on the use of expensive and bulky free weights such a dumbbells, the disclosed adjustable lower body fitness devices use relatively compact weight increments that can be easily stacked and stored. As a result, using the disclosed adjustable lower body fitness devices there is no need to invest in, and maintain, racks of dumbbells or other space intensive weight systems in order to provide variable levels of workout and flexibility.

As a result of these and other disclosed features, which are discussed in more detail below, the disclosed embodiments address the short comings of the prior art and provide a technical solution to the long-standing technical problem of providing a method and system that allows users to effectively and efficiently exercise their lower body and core while also providing flexibility, minimal floor space and storage requirements, simplicity, relatively low cost, and minimal maintenance requirements.

The present invention has been described in particular detail with respect to specific possible embodiments. Those of skill in the art will appreciate that the invention may be practiced in other embodiments. For example, the nomenclature used for components, capitalization of component designations and terms, the attributes, or structural aspect is not significant, mandatory, or limiting, and the mechanisms that implement the invention or its features can have various different names, formats, or protocols. Also, particular divisions of functionality between the various components described herein are merely exemplary, and not mandatory or significant. Consequently, functions performed by a single component may, in other embodiments, be performed by multiple components, and functions performed by multiple components may, in other embodiments, be performed by a single component.

In addition, the operations shown in the FIGs., or as discussed herein, are identified using a particular nomenclature for ease of description and understanding, but other nomenclature is often used in the art to identify equivalent operations.

Therefore, numerous variations, whether explicitly provided for by the specification or implied by the specification or not, may be implemented by one of skill in the art in view of this disclosure.

What is claimed is:

1. An adjustable lower body fitness device comprising:

a body attachment portion configured to be attachable to and detachable from a foot of a user, the body attachment portion including a base support portion, the base support portion having a flat bottom surface such that when the user is standing, the flat bottom surface of the base support portion is in direct contact with a surface on which the user is standing;

an adjustable weight portion, the adjustable weight portion being attached to the body attachment portion of the adjustable lower body fitness device such that the adjustable height portion extends to a right and left of the body attachment portion and that when the body attachment portion of the adjustable lower body fitness device is attached to the user the adjustable weight portion becomes an extension of the user's leg, the adjustable weight portion including a weight increment attachment mechanism; and one or more weight increments, the one or more weight increments being attachable to and detachable from the adjustable weight portion such that a total weight of the adjustable weight portion of the adjustable lower body fitness device is configured to be adjusted by attaching or detaching one or more of the one or more weight increments wherein, the one or more weight increments are attached to the adjustable weight portion of the adjustable lower body fitness device such that the one or more weight increments extend along a horizontal axis of the flat bottom surface of the base support portion of the adjustable lower body fitness device such that when the user is standing, the flat bottom surface of the base support portion is in direct contact with the surface on which the user is standing.

2. The adjustable lower body fitness device of claim 1 wherein the body attachment portion includes a first surface and a second surface configured such that when the body attachment portion is attached to the user's foot the first surface supports a bottom of the user's foot and the second surface supports a rear of the user's foot.

3. The adjustable lower body fitness device of claim 2 wherein the body attachment portion is configured to be attached to footwear within which the user's foot is disposed such that when the body attachment portion is attached to the user's foot the first surface is configured to contact a sole of the footwear and the second surface is configured to contact a rear of the footwear.

4. The adjustable lower body fitness device of claim 2 wherein the first surface and the second surface are perpendicular with the first surface being flat and the second surface being curved.

5. The adjustable lower body fitness device of claim 1 wherein the body attachment portion includes at least one strap mechanism configured to secure the user's foot to the body attachment portion.

6. The adjustable lower body fitness device of claim 1 wherein the weight increment attachment mechanism is a slot and selection plate weight increment attachment mechanism.

7. The adjustable lower body fitness device of claim 1 wherein the weight increment attachment mechanism is a hole and pin weight increment attachment mechanism.

8. The adjustable lower body fitness device of claim 1 wherein the weight increment attachment mechanism is a screw and bolt weight increment attachment mechanism.

9. The adjustable lower body fitness device of claim 1 wherein the weight increment attachment mechanism is a hook and loop weight increment attachment mechanism.

10. The adjustable lower body fitness device of claim 1 wherein the weight increment attachment mechanism is a magnet weight increment attachment mechanism.

11. The adjustable lower body fitness device of claim 1 wherein the weight increment attachment mechanism is a slot and groove weight increment attachment mechanism.

12. An adjustable lower body fitness device comprising:

a body attachment portion configured to be attachable to and detachable from a foot of a user, the body attachment portion including a base support portion, the base support portion having a flat bottom surface such that when the user is standing, the flat bottom surface of the base support portion is in direct contact with a surface on which the user is standing;

an adjustable weight portion, the adjustable weight portion being attached to the body attachment portion of the adjustable lower body fitness device such that the adjustable height portion extends to a right and left of the body attachment portion and that when the body attachment portion of the adjustable lower body fitness device is attached to the user the adjustable weight portion becomes an extension of the user's leg, the adjustable weight portion including a weight increment attachment mechanism;

one or more weight increments, the one or more weight increments being attachable to and detachable from the adjustable weight portion such that a total weight of the adjustable weight portion of the adjustable lower body fitness device is capable of being adjusted by attaching or detaching one or more of the one or more weight increments wherein, the one or more weight increments are attached to the adjustable weight portion of the adjustable lower body fitness device such that the one or more weight increments extend along a horizontal axis of the flat bottom surface of the base support portion of the adjustable lower body fitness device such that when the user is standing, the flat bottom surface of the base support portion is in direct contact with the surface on which the user is standing; and the adjustable weight portion further comprises an adjustable lower body fitness device docking station, the adjustable lower body fitness device docking station including at least some of the one or more weight increments to be combined and attached to the adjustable weight portion of the lower body weight training fitness device, the adjustable lower body fitness device docking station configured to receive the lower body weight training fitness device, such that the user is provided the capability to select the desired total weight for the adjustable weight portion of the lower body weight training fitness device using the weight selection mechanism.

13. The adjustable lower body fitness device of claim 12 wherein the body attachment portion comprises a first surface and a second surface configured such that when the body attachment portion is attached to the user's foot the first surface supports a bottom of the user's foot and the second surface supports a rear of the user's foot.

14. The adjustable lower body fitness device of claim 13 wherein the body attachment portion is configured to be attached to footwear within which the user's foot is disposed such that when the body attachment portion is attached to the user's foot the first surface is configured to contact a sole of the footwear and the second surface is configured to contact a rear of the footwear.

15. The adjustable lower body fitness device of claim 13 wherein the first surface and the second surface are perpendicular with the first surface being flat and the second surface being curved.

16. The adjustable lower body fitness device of claim 12 wherein the body attachment portion includes at least one strap mechanism configured to secure the user's foot to the body attachment portion.

17. A method comprising:

providing an adjustable lower body fitness device, the adjustable lower body fitness device including:

a body attachment portion configured to be attachable to and detachable from a foot of a user, the body attachment portion including a base support portion, the base support portion having a flat bottom surface such that when the user is standing, the flat bottom surface of the base support portion is in direct contact with a surface on which the user is standing;

an adjustable weight portion, the adjustable weight portion being attached to the body attachment portion of the adjustable lower body fitness device such that the adjustable height portion extends to a right and left of the body attachment portion and that when the body attachment portion of the adjustable lower body fitness device is attached to the user the adjustable weight portion becomes an extension of the user's leg, the adjustable weight portion including a weight increment attachment mechanism; and one or more weight increments, the one or more weight increments being attachable to and detachable from the adjustable weight portion such that a total weight of the adjustable weight portion of the adjustable lower body fitness device is configured to be adjusted by attaching or detaching one or more of the one or more weight increments wherein, the one or more weight increments are attached to the adjustable weight portion of the adjustable lower body fitness device such that the one or more weight increments extend along a horizontal axis of the flat bottom surface of the base support portion of the adjustable lower body fitness device such that when the user is standing, the flat bottom surface of the base support portion is in direct contact with the surface on which the user is standing.

18. The method of claim 17 wherein the body attachment portion of the adjustable lower body fitness device includes a first surface and a second surface configured such that when the body attachment portion is attached to the user's foot the first surface supports a bottom of the user's foot and the second surface supports a rear of the user's foot.

19. The method of claim 17 further comprising:

the user performing one or more lower body exercises while the adjustable lower body fitness device is attached to the user by the body attachment portion of the adjustable lower body fitness device.

20. An adjustable lower body fitness device comprising:

a body attachment portion configured to be attachable to and detachable from a foot of a user, the body attachment portion including:

a base support portion including a flat portion configured to accept at least part of the bottom of a user's foot, the base support portion having a flat bottom surface such that when the user is standing, the flat bottom surface of the base support portion is in direct contact with a surface on which the user is standing;

a lateral support portion including a cupping surface configured to accept at least a portion of the user's heel;

a front portion designed and configured to fit over at least a portion of the front of the user's foot or ankle; and one or more strap mechanisms used to secure the user's foot and/or ankle to the adjustable lower body fitness device by securing the user's foot and/or ankle between an adjustable cavity formed by the base support portion, the lateral support portion, and the front portion of the body attachment portion of the adjustable lower body fitness device;

an adjustable weight portion, the adjustable weight portion being attached to the body attachment portion of the adjustable lower body fitness device such that the adjustable height portion extends to a right and left of the body attachment portion and that when the body attachment portion of the adjustable lower body fitness device is attached to the user the adjustable weight portion becomes an extension of the user's leg, the adjustable weight portion including a weight increment attachment mechanism; and one or more weight increments, the one or more weight increments being attachable to and detachable from the adjustable weight portion such that a total weight of the adjustable weight portion of the adjustable lower body fitness device is configured to be adjustable by attaching or detaching one or more of the one or more weight increments wherein, the one or more weight increments are attached to the adjustable weight portion of the adjustable lower body fitness device such that the one or more weight increments extend along a horizontal axis of the flat bottom surface of the base support portion of the adjustable lower body fitness device such that when the user is standing, the flat bottom surface of the base support portion is in direct contact with the surface on which the user is standing.

* * * * *